US012774655B2

(12) United States Patent
Nicholson et al.

(10) Patent No.: US 12,774,655 B2
(45) Date of Patent: Oct. 27, 2026

(54) MULTI-STAGE SYSTEM

(71) Applicant: KN GG IP HOLDING AND LICENSING, LLC, Fort Lauderdale, FL (US)

(72) Inventors: Kenneth Nicholson, Oakland Park, FL (US); George Gounaris, Fort Lauderdale, FL (US)

(73) Assignee: KN GG IP HOLDING AND LICENSING, LLC, Fort Lauderdale, FL (US)

( * ) Notice: Subject to any disclaimer, the term of this patent is extended or adjusted under 35 U.S.C. 154(b) by 0 days.

(21) Appl. No.: 19/355,823

(22) Filed: Oct. 10, 2025

(65) Prior Publication Data

US 2026/0103985 A1 Apr. 16, 2026

Related U.S. Application Data

(60) Provisional application No. 63/706,576, filed on Oct. 11, 2024.

(51) Int. Cl.
*F01B 3/08* (2006.01)
*F01B 3/04* (2006.01)
*F01B 9/06* (2006.01)

(52) U.S. Cl.
CPC ..... *F01B 3/08* (2013.01); *F01B 3/045* (2013.01); *F01B 9/06* (2013.01)

(58) Field of Classification Search
CPC .. F01B 3/04; F01B 9/06; F01B 1/0603; F02B 19/18
See application file for complete search history.

(56) References Cited

U.S. PATENT DOCUMENTS 4,090,478 A * 5/1978 Trimble ..... F01B 3/0005 92/33
4,337,699 A * 7/1982 Beisel ..... B41F 31/15 74/57
4,366,784 A * 1/1983 Paul ..... F01B 3/04 123/47 A
4,418,656 A 12/1983 Stanton
4,462,345 A 7/1984 Routery
5,743,220 A 4/1998 Guarner-Lans
(Continued)

FOREIGN PATENT DOCUMENTS

CN 208281048 U 12/2018
GB 2459025 A 10/2009
(Continued)

*Primary Examiner* — George C Jin
*Assistant Examiner* — Teuta B Holbrook
(74) *Attorney, Agent, or Firm* — Buchalter LLP

(57) ABSTRACT

A multi-stage system includes a block defining a cylinder, the cylinder comprising an inlet thereto and an outlet therefrom and a linear grove disposed axially within the cylinder, an infinity; a power transfer shaft configured for rotation within the cylinder, the power transfer shaft comprising a shaft portion and an infinity portion, the infinity portion defining an infinity profile; and a piston configured to reciprocate within the cylinder, the piston defining a first compression chamber and a second compression chamber within the cylinder, the piston slidably engaging the infinity profile of the power transfer shaft.

20 Claims, 15 Drawing Sheets

(56) References Cited

U.S. PATENT DOCUMENTS

| | | | | | |
|---|---|---|---|---|---|
| 6,145,482 | A * | 11/2000 | Blount | F01B 3/04 418/68 |
| 8,640,659 | B2 * | 2/2014 | Daouk | F01B 9/06 123/51 R |
| 9,091,204 | B2 | 7/2015 | Mcalister | |
| 2004/0149122 | A1 | 8/2004 | Vaughan | |

FOREIGN PATENT DOCUMENTS

| | | | | | |
|---|---|---|---|---|---|
| JP | 2005002812 | A | | 1/2005 | |
| KR | 20060051200 | A | * | 5/2006 | F04B 27/1054 |
| RU | 2468225 | C2 | * | 11/2012 | |
| RU | 2476700 | C2 | * | 2/2013 | |
| WO | 8604637 | A1 | | 8/1986 | |
| WO | WO-2005003595 | A1 | * | 1/2005 | F01B 3/04 |

* cited by examiner

MULTI-STAGE SYSTEM

CROSS-REFERENCE TO RELATED APPLICATIONS

The present application claims the benefit of U.S. Provisional Patent Application No. 63/706,576, filed Oct. 11, 2024, which is hereby specifically incorporated by reference herein in its entirety.

TECHNICAL FIELD

This disclosure relates to devices such as engines, compressors, or pumps. More specifically, this disclosure relates to a multi-stage internal combustion engine, compressor, or pump.

BACKGROUND

Internal combustion engines are arguably one of the most important technologies today; their influence is observed in virtually all industries such as transportation, power generation, agriculture, aviation, and others. Internal combustion engines are operable to transform chemical energy in liquid fuels into mechanical energy by way of a reciprocating piston that forces a crankshaft to turn as a result of the pressure of combusting fuel acting against the piston. Further, these engines utilize a thermodynamic cycle which includes a compression step to extract work from the fuel. In general, internal combustion engines comprise a single combustion chamber and a single compression step. Increasingly stringent fuel economy and emissions standards are driving developments in engine architecture that is operable to extract more potential energy from fuels and provide more efficient combustion. Combustion engines are particularly limited to the single stage compression event that occurs with conventional engine architecture. Moreover, the method of converting the reciprocal motion of the piston into rotation motion of the crankshaft can further introduce mechanical loss.

Compressors can be used to increase the pressure of a gas and pumps can be used to move fluid, such as air or liquid. Compressors and pumps are typically single-stage devices, or typically require multiple compressors or pumps linked in sequence separately to accomplish multistage compression and/or pumping.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Disclosed is a multi-stage system comprising a block defining a cylinder, the cylinder comprising an inlet thereto and an outlet therefrom and a linear groove disposed axially within the cylinder, a power transfer shaft configured for rotation within the cylinder, the power transfer shaft defining an infinity groove, and a piston configured to reciprocate within the cylinder, the piston defining a first compression chamber and a second compression chamber within the cylinder, the piston comprising a pin configured to be received by the linear groove and the infinity groove.

Also disclosed is a method of completing a thermodynamic cycle, comprising compressing a first gas within at least one chamber in a first compression step; compressing at least one of the first gas or a second gas in another chamber in a second compression step; initiating a combustion event to generate expansion work; and venting exhaust generated by the combustion event.

Further disclosed is a multi-stage system comprising a block defining a cylinder, the cylinder comprising an inlet thereto and an outlet therefrom; a power transfer shaft configured for rotation within the cylinder, the power transfer shaft comprising a shaft portion and an infinity portion, the infinity portion defining an infinity profile; and a piston configured to reciprocate within the cylinder, the piston defining a first compression chamber and a second compression chamber within the cylinder, the piston slidably engaging the infinity profile of the power transfer shaft.

Additionally, disclosed is a method of completing a thermodynamic cycle comprising compressing a first gas within at least a first chamber in a first compression step; compressing at least one of the first gas or a second gas in a second chamber in a second compression step; initiating a combustion event to generate expansion work; and venting exhaust generated by the combustion event.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
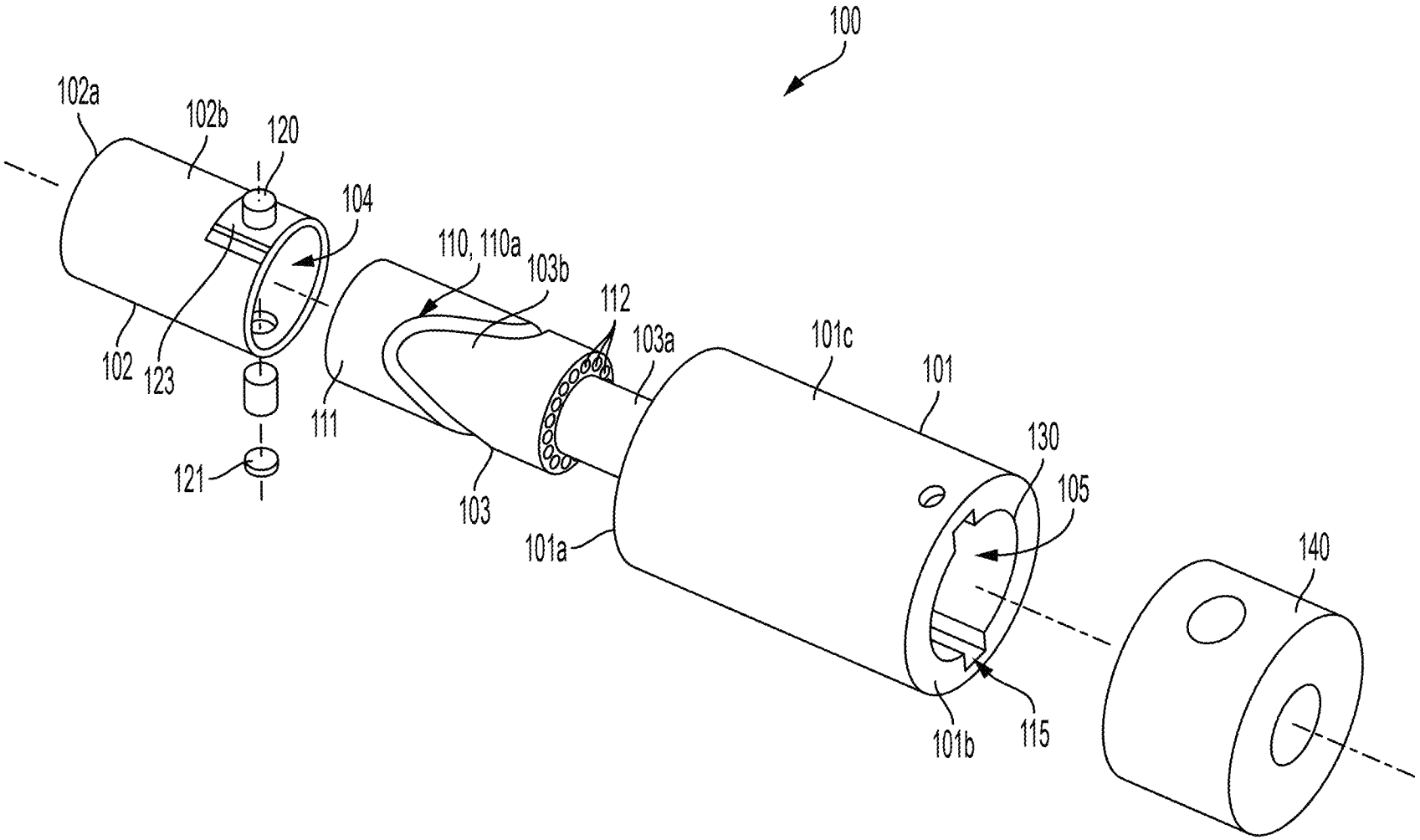
FIG. 1 is an exploded view of a multi-stage compression system, in accordance with one example aspect of the present disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutations of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed in the present application is a multi-stage compression engine and/or multi-stage compressor or pump and associated methods, systems, devices, and various apparatus. Example aspects of the multi-stage compression engine and/or multistage compressor or pump can comprise a first compression chamber, a second compression chamber, and a piston. The piston can define a combustion chamber. The multi-stage compression engine and/or multistage compressor or pump can comprise a power transfer shaft defining an infinity profile. It would be understood by one of skill in the art that the disclosed multi-stage compression engine and/or multi-stage compressor or pump is described in but a few exemplary aspects among many. No particular terminology or description should be considered limiting on the disclosure or the scope of any claims issuing therefrom.

FIG. 1 illustrates an exploded view of a first aspect of a multi-stage system, and more specifically, a multi-stage compression engine 100, according to the present disclosure. In other aspects, the multi-stage system can comprise a multi-stage pump or a multi-stage compressor, which can be substantially similar to the multi-stage compression engine 100 of FIG. 1. For purposes of simplicity, the following description of various aspects of the structure and function of the multi-stage compression engine 100 can similarly describe such a multi-stage pump or multi-stage compressor, except that multi-stage pump or multi-stage compressor 100 can function as a pump or compressor rather than an engine. Any of the multi-stage compression engine 100, the multi-stage pump, and the multistage compressor can be referred to as the "multi-stage system 100." Example aspects of the multistage pump or compressor can allow multiple and/or separate compression or pumping steps. Example aspects of the multi-stage compression engine 100 can be an internal combustion engine comprising a multi-stage compression system, for example, a thermodynamic cycle defining more than one compression and/or combustion events (e.g., two, four, etc.) per revolution.

As shown, the multi-stage compression engine 100 (and/or the multi-stage pump or multi-stage compressor) can comprise a cylinder 101 and a piston 102 configured to reciprocate within the cylinder 101. The piston 102 can be movably mounted on a power transfer shaft 103, and the power transfer shaft 103 can define an infinity profile 110, as described in further detail below. The infinity profile 110 of the power transfer shaft 103 can be an integrated or added feature of the power transfer shaft 103. Example aspects of the piston 102 can be substantially cylindrical in shape. In some aspects, the piston 102 can define a shape and/or can comprise features that can prevent rotation of the piston 102 within the cylinder 101. For example, the piston 102 may incorporate features (such as planar portions 1512, shown in FIG. 15) configured to interact with the cylinder 101 to prevent rotation of the piston 102 within the cylinder 101. The cylinder 101 can define a cylinder bore 105. In some aspects, the piston 102 can be sized to be received by the cylinder bore 105. The cylinder bore 105 can define a travel path for the piston 102. The piston 102 can define a piston crown 102*a*, and a piston skirt 102*b*. The piston skirt 102*b* can define an outer piston surface and an inner piston surface. The inner piston surface can define a piston bore 104. The piston bore 104 can be a blind bore 104 which can extend partially through the piston 102 and within which the power transfer shaft 103 can be received. The piston 102 can define a proximal piston end and a distal piston end, wherein the proximal piston end comprises the piston crown 102*a* and the distal piston end defines the piston bore 104. The piston bore 104 can be proximal to the infinity profile 110 on the power transfer shaft 103 and can define a hollow void configured to receive the power transfer shaft 103.

The piston 102 can comprise one or more piston pins 120. The piston 102 can comprise two pins 120 in the present aspect, but can comprise more pins 120 or less pins 120 in other aspects. The piston pins 120 can be defined on the skirt 102*b* of the piston 102 and can extend therefrom. In some aspects, the pins 120 can extend perpendicularly from the skirt 102*b*. In some aspects, the piston pins 120 can be substantially solid and can be a structural element of the piston 102. In some aspects, the piston pin 120 can comprise a pin bearing 121. The pin bearing 121 can be configured to provide rotation between the pin 120 and an external structure. The pin 120 can be received by a hole disposed in the skirt 102*b* of the piston 102. In some aspects, the pin 120 can attached to or integral with a portion of the skirt 102*b*. In some aspects, the pin 120 can form an interference fit with a portion of the skirt 102*b*. In some aspects, the pin 120 can be monolithically formed (i.e., formed a singular component that constitutes a single material without joints or seams) with the skirt 102*b* of the piston 102. According to example aspects, the piston 102 can comprise a pair of the pins 120 disposed on a portion of the skirt 102*b*. The pins 120 can be oriented 180 degrees apart from each other and can define a pin axis. In some aspects, the pin(s) 120 can extend into the piston bore 104. According to some example aspects, the pin(s) 120 can initiate within the piston bore 104 and can extend through the skirt 102*b* of the piston 102 past the surface of the skirt 102*b*. Optionally, the piston 102 can comprise a pin boss 123 disposed on the skirt 102*b*. The pin boss 123 can be a raised portion of the skirt 102*b* and can be configured to enhance the structural integrity of the area of the piston 102 proximal to the pin(s) 120.

In other aspects, the piston 102 can comprise the infinity profile 110, and the pin 120 can be coupled to or monolithically or integrally formed with the power transfer shaft 103 and can engage the infinity profile 110 of the piston 102.

Example aspects of the cylinder 101 can be substantially cylindrical in shape and can define a cylinder proximal end 101*a*, a cylinder distal end 101*b* opposite the cylinder proximal end 101*a*, and a cylinder sidewall 101*c* extending therebetween. The cylinder sidewall 101*c* can define an outer cylinder sidewall surface and an inner cylinder sidewall surface. The inner cylinder sidewall surface can define the cylinder bore 105 through the cylinder 101, within which the piston 102 and power transfer shaft 103 can be received. The cylinder bore 105 can define an inlet 230 (shown in FIG. 2) at the cylinder proximal end 101*a* and an outlet 130 at the cylinder distal end 101*b* of the cylinder 101. In the present aspect, the cylinder 101 can be substantially co-axial with the piston 102. In some aspects, the piston 102 can be configured to reciprocate within the cylinder bore 105.

As shown, the cylinder bore 105, and more generally the cylinder 101, can comprise a pin slot 115. The pin slot 115 can be a recessed region in the cylinder 101 and can be formed as an elongated, linear cylinder groove 115, which can extend fully or partially along the length of the cylinder 101. The pin slot 115 can be formed in the inner cylinder sidewall surface of the cylinder bore 105 and can be configured to engage the pin 120 and optionally the pin bearing 121. In example aspects, the cylinder 101 can comprise a pair of pin slots 115 disposed 180 degrees apart in the cylinder bore 105. In some aspects, the pin slot 115 can be configured to receive the pin 120 and can initiate at the cylinder proximal end 101*a* and can terminate at the piston distal end 101*b*. In some aspects, the pin slot 115 can initiate at the cylinder distal end 101*b* and can partially through the length of the cylinder bore 105. According to example aspects, each of the pins 120 can engage a corresponding one of the pin slots 115 to prohibit rotation of the piston 102 relative to the cylinder 101.

In some aspects, the piston 102 and/or the cylinder 101 can comprise one or more additional or alternative anti-rotation features. For example and without limitation, in another example aspects, the cylinder bore 105 and/or the piston 102 received therein, or portions thereof, can define a geometric cross-sectional shape—other than a circle—that can prohibit rotation of the piston 102 within the cylinder 101. For example and without limitation, the geometric cross-sectional shape may be include an oval, rectangle, triangle, pentagon, hexagon, etc. In other aspects, such as the aspect shown in FIG. 15, the piston 102 can define planar portions 1512 configured to interact with the cylinder 101 to prevent the piston 102 from rotating within the cylinder 101

Figure 2:
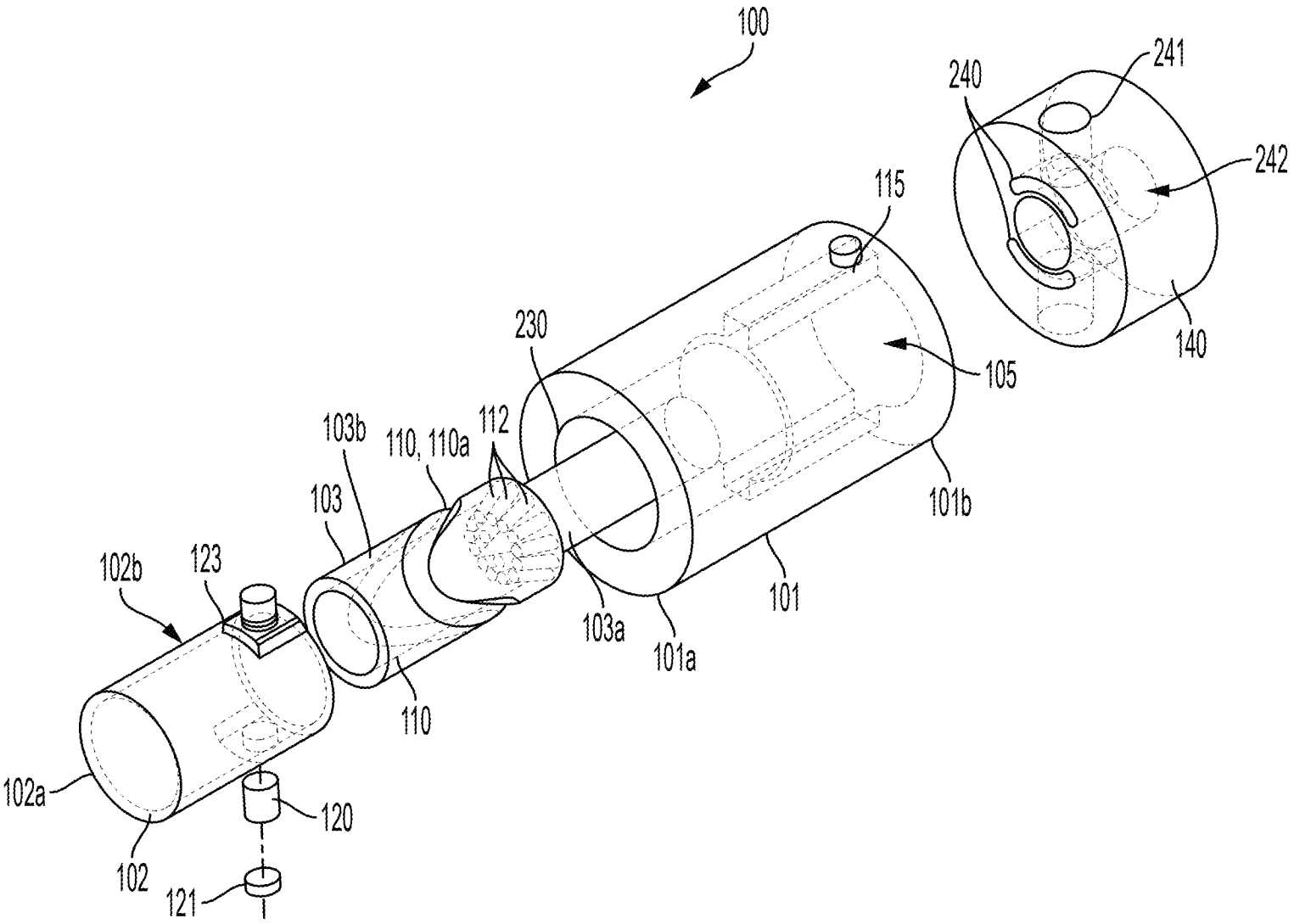
FIG. 2 is an exploded view of the multi-stage compression system of FIG. 1, showing various components in transparency.

In some aspects, the multi-stage compression engine 100 can comprise a power transfer shaft case 140. The power transfer shaft case 140 can be configured to be received at an end of the cylinder 101, for example the cylinder distal end 101*b*. As shown in FIG. 2, the power transfer shaft case 140 can define one or more ports 241 and a shaft journal 242, as described in further detail below. Additionally, as shown in FIG. 2, the power transfer shaft case 140 can define one or more fluid slots 240, each in fluid communication with a corresponding one of the ports 241, as described in further detail below.

In some aspects, the multi-stage compression engine 100 can comprise the power transfer shaft 103 defining the infinity profile 110. The power transfer shaft 103 can comprise an elongated cylinder configured for rotation. Example aspects of the power transfer shaft 103 can comprise a shaft portion 103*a* and an infinity portion 103*b* (which can be a grooved portion 103*b* in the present aspect). The shaft portion 103*a* can comprise a shaft, for example and without limitation. In other aspects, the shaft portion 103*a* can be any suitable type of shaft known in the art. The shaft portion 103*a*, which can also be called a "rotational shaft portion", can extend axially from a proximal end of the grooved portion 103*b*. The grooved portion 103*b* can define the infinity profile 110. The shaft portion 103*a* of the power transfer shaft 103 can be configured for rotation and structured to transmit torque generated from the multi-stage compression engine 100. In other aspects, the multi-stage pump or multi-stage compressor can receive rotational energy to act as a compressor and/or pump. In example aspects, the shaft portion 103*a* can be a substantially solid and cylindrical shaft.

The power transfer shaft 103, and more specifically, the grooved portion 103*b* thereof, can be received by the piston bore 104. The grooved portion 103*b* of the power transfer shaft 103 can be sized to be received by the piston bore 104 and can be configured for rotation therein. The power transfer shaft 103 can comprise a plurality of fluid bores 112 disposed at the proximal end of the grooved portion 103*b*. The fluid bores 112 can allow fluid communication between the piston bore 104 and the fluid slots 240 of the power transfer shaft case 140. In other aspects, the fluid bores 112 can be formed as slots or any other suitable opening. In example aspects, the grooved portion 103*b* of the power transfer shaft 103 can define an inner shaft surface 311 (shown in FIG. 3) and an outer shaft surface 111 opposite the inner shaft surface 311. The inner shaft surface 311 can define a hollow interior portion. In example aspects, the outer shaft surface 111 can define the infinity profile 110. The infinity profile 110 can be a feature extending about the circumference of the grooved portion 103*b* of the power transfer shaft 103. In some aspects, the infinity profile 110 can be shaped in a wave, such as, for example and without limitation, a sine or cosine wave, although it will be understood by one of ordinary skill in the art that other periodic waves are contemplated.

In some aspects, as shown in FIG. 1, the infinity profile 110 can be the infinity groove 110*a* which can comprise a recessed feature, such as a groove, in the outer shaft surface 111 of the grooved portion 103*b*, and which can define a wave function pattern. In other aspects, the infinity profile 110 can be an infinity projection 110*b* (shown in FIG. 6) which can comprise a raised portion such as an infinity ridge 110*b*, tab, tongue or the like. The shaft portion 103*a* can also define a feature to allow action on the piston 102 via a push valve 901 (shown in FIG. 9) which could be mechanically, hydraulically, or electromechanically actuated.

FIG. 2 illustrates an exploded view of the multi-stage compression engine 100 of FIG. 1. In some aspects, the power transfer shaft case 140 can comprise a shaft journal 242. The shaft journal 242 can define a substantially cylindrical hole in the power transfer shaft case 140 and can be disposed in line with the shaft portion 103*a* of the power transfer shaft 103. In some aspects, the shaft journal 242 can be configured to support the shaft portion 103*a* and provide a rotational surface therebetween. The power transfer shaft case 140 can comprise one or more ports 241. The ports 241 can be disposed on a surface of the power transfer shaft case 140 and can be configured for fluid transfer. In some aspects, the ports 241 can be configured to provide fluid communication between one or more of a valve-train, an air source, a fuel source, a scavenging source, or the like. In some aspects, the ports 241 can be configured to provide selective fluid communication between any of the foregoing and the multi-stage compression engine 100. The ports 241 can be configured to extend through a portion of the power transfer shaft case 140. In some aspects, the ports 241 can be configured to extend from an external surface of the power transfer shaft case 140 to the shaft journal 242. In some aspects, the ports 241 can be sizeably configured to increase the momentum of an air charge.

Figure 3:
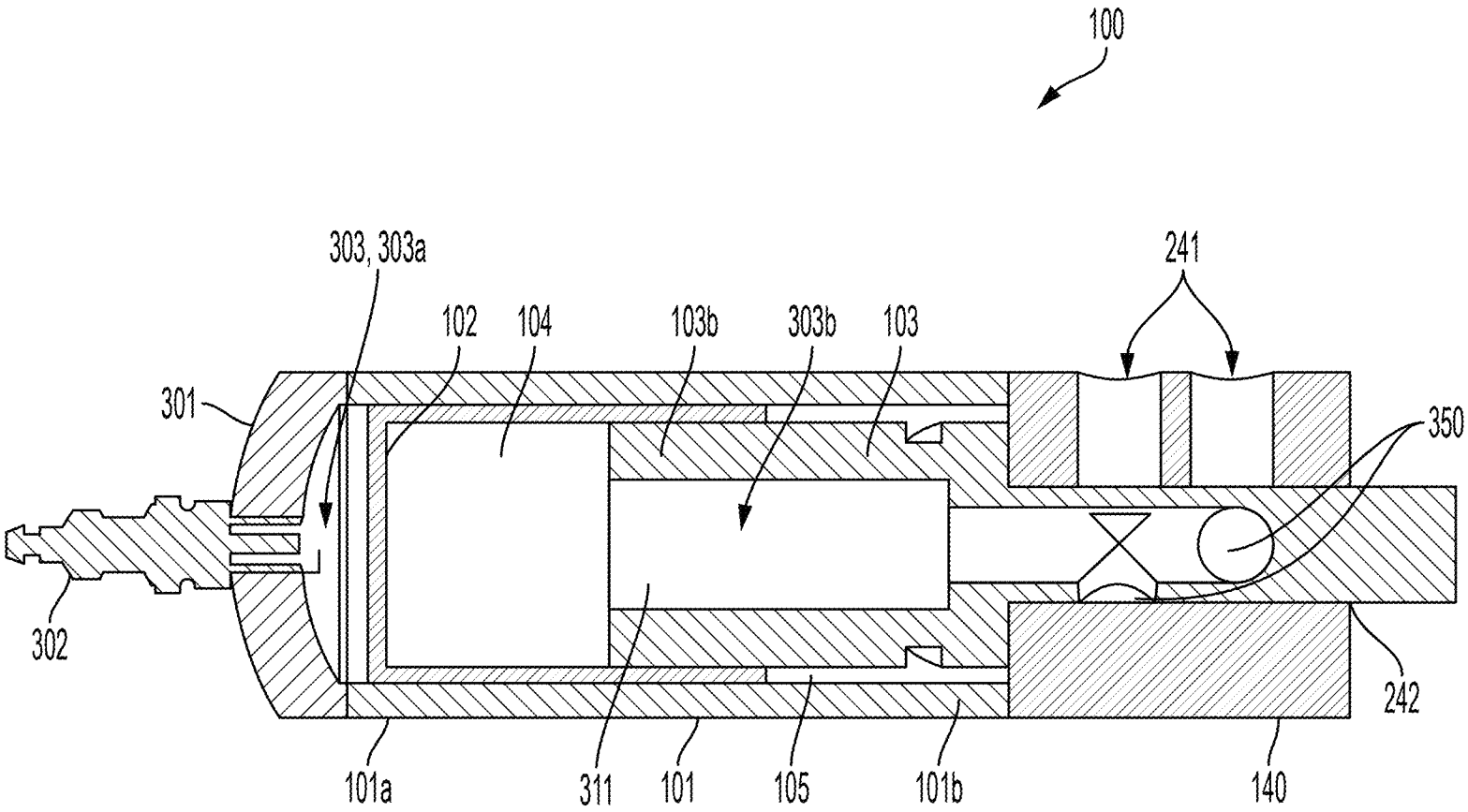
FIG. 3 is a cross sectional view of the multi-stage compression system of FIG. 1.

FIG. 3 illustrates the piston 102 mounted on the power transfer shaft 103, and more specifically, on the grooved portion 103*b* thereof. In some aspects, the piston 102 can be received by the cylinder bore 105, and more generally by the cylinder 101. The piston 102 can comprise one or more piston rings (not shown), or another other suitable type of sealing element, which can be configured to provide a seal between the piston 102 and the cylinder bore 105. Additionally, one or more sealing elements can be provided between the power transfer shaft 103 and the piston bore 104, as described in additional detail below. In some aspects, the cylinder can comprise a cylinder head 301. The cylinder head 301 can be a structure configured to encapsulate one end of the cylinder 101. In some aspects, the cylinder head 301 can be mounted onto the cylinder proximal end 101*a*. The cylinder head 301 can comprise an ignition source. The ignition source can be a sparkplug 302, for example and without limitation.

The sparkplug 302 can be threadedly received by the cylinder head 301 and can extend therethrough. The sparkplug 302 can be configured to selectively generate an ignition event. In some aspects, the multi-stage compression engine 100 can comprise a combustion chamber 303. The combustion chamber 303 can be disposed within the cylinder bore 105, and more generally within the cylinder 101. In some aspects, the combustion chamber 303 can be defined in the cylinder bore 105 between the cylinder head 301 and the piston crown 102*a*. The combustion chamber 303 can be geometrically configured to sustain a reaction, such as a combustion reaction. In example aspects, the piston 102 can be configured to reciprocate within the cylinder bore 105. The piston 102 can be configured to reciprocate two or more times (e.g., 2, 4, or 8 times, for example and without limitation) within the cylinder bore 105 per rotation of the power transfer shaft 103. In some aspects, the cylinder bore 105 can contain a fuel air charge. In some aspects, the piston 102 can be configured to compress the fuel air charge. In some aspects, the piston 102 can be configured compress contents within the cylinder bore 105.

In an exemplary aspect, a fuel air charge can be inducted into the cylinder bore 105 and can be compressed by the piston 102. The sparkplug 302 can be disposed in the combustion chamber 303 and can selectively provide ignition to the fuel air charge. The combination of the piston 102, cylinder 101, and cylinder head 301 can be configured to capture expansion work provided during a thermodynamic process. The combination of the piston 102, cylinder 101, and cylinder head 301 can be configured to perform work on a thermodynamic system, such as compression work. In some aspects, the combustion chamber can be a first chamber 303*a*. The first chamber 303*a* can be structured to be one of a combustion chamber or a pure compression chamber, such as in a traditional four-stroke diesel engine.

The piston bore 104 can be configured to receive at least a portion of the power transfer shaft 103. The piston bore 104 can be configured to define a variable volume. In some aspects, the combination of the piston bore 104 and the power transfer shaft 103 can define a second chamber 303*b*. For example, one or more of the sealing elements can be provided between the power transfer shaft 103 and the piston bore 104 as previously described in order to form the second chamber 303*b*. In some aspects, the second chamber 303*b* can be a compression chamber. In some aspects, the second chamber 303*b* can be a combustion chamber. In some aspects, the first chamber 303*a* can be in fluid communication with the second chamber 303*b*. The second chamber 303*b* can define a volume within the piston 102 and the power transfer shaft 103. In some aspects, power transfer shaft 103 can comprise a rotary valve 350. The rotary valve 350 can be defined in the shaft portion 103*a*, and more generally in the power transfer shaft 103. In some aspects the rotary valve 350 can define a void in a portion of the shaft portion 103*a*.

The rotary valve 350 can be configured to open and close to selectively continue or discontinue fluid transfer, and/or to increase pressure within the power transfer shaft case 140 (or another chamber) to supercharge the fuel air charge therein. In example aspects, the rotary valve 350 can be configured to provide selective fluid communication between the ports 241 and the second chamber 303*b*. The rotary valve 350 can be configured to rotate with the shaft portion 103*a*. In example aspects, the multi-stage compression engine 100 can comprise an intake port 241 and an intake rotary valve 350 and an exhaust port 241 and an exhaust rotary valve 350. In some aspects, the rotary valve 350 can be configured to promote fluid transfer between the multi-stage compression engine 100 and a secondary system. In some aspects, the second chamber 303*b* can contain separate gas, such as air only, that can travel to a holding tank for introduction into the cycle at a later point. Or, when the multi-stage system is a multi-stage compressor, secondary compression of gas can be transferred to the first chamber 303*a* to multiply the compression.

Figure 4:
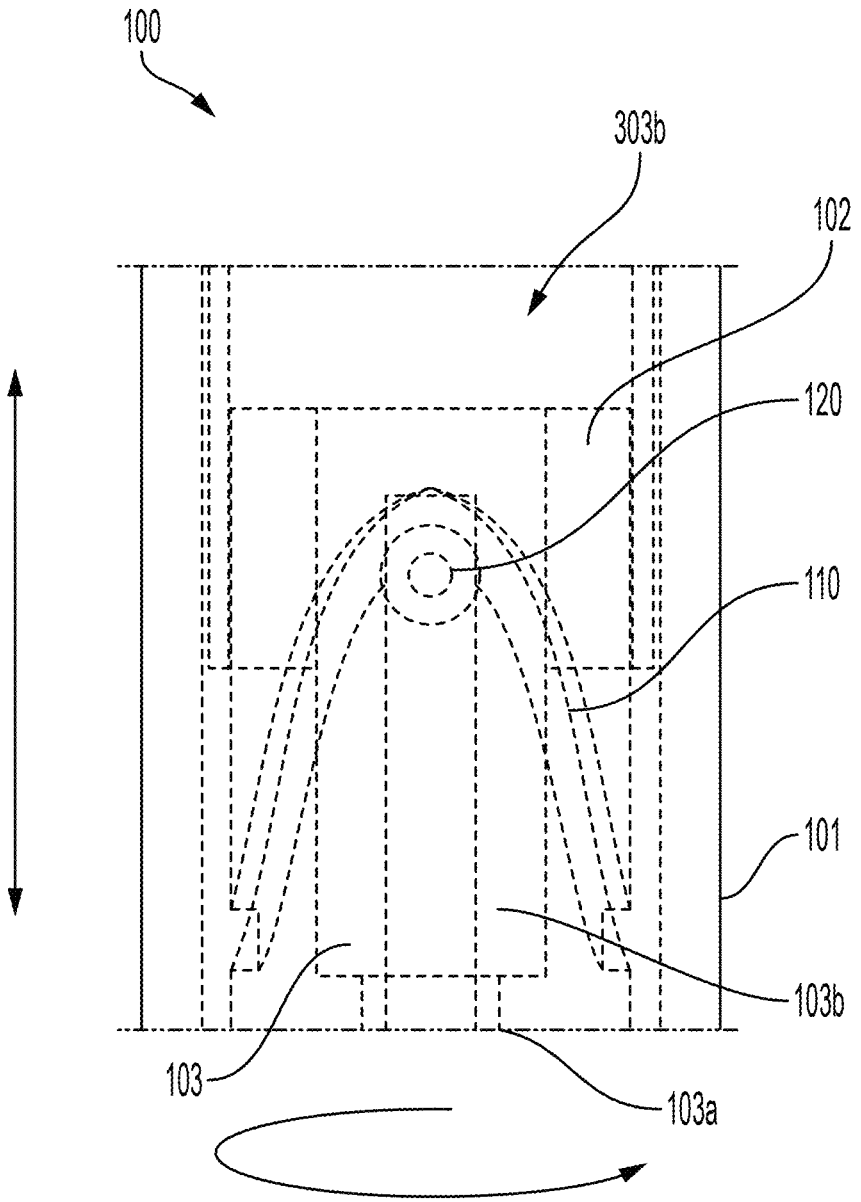
FIG. 4 is another cross sectional view of the multi-stage compression system of FIG. 1.

FIG. 4 illustrates the cylinder of the multi-stage compression engine 100 illustrating an example engagement between the piston 102 and the power transfer shaft 103. In example aspects, the piston 102, the power transfer shaft 103, and the cylinder 101 can be mechanically coupled. In some aspects, the piston 102 can be mechanically coupled to the cylinder 101 via the pin(s) 120. In some aspects, the pin 120 can extend from the piston 102 and be received by the cylinder 101. For example only, the pin 120 can extend from the skirt 102*b* of the piston 102, and a first pin end thereof can be received by the slot 115 of the cylinder 101. In many aspects, the pin 120 is configured to slidably engage with the slot 115. The slot 115 can define a reciprocal travel path for the pin 120 and more generally, the piston 102. In some aspects, the slot 115 can be configured to constrain the piston 102 to a single axis of translation.

In some aspects, the infinity groove 110*a* and more generally, the infinity profile 110, can be configured to receive a second pin end of the pin 120, opposite the first pin end, which can be disposed on the piston bore 104. The infinity profile 110 can define a curvilinear travel path for the piston pin 120 and more generally, the piston 102. In some aspects, the infinity groove 110*a* can define a linear travel path for the piston 102 and a rotational path for the power transfer shaft 103. In exemplary aspects, the combination of the slots 115 in the cylinder 101, the piston 102 and pin 120, and the power transfer shaft 103 with the infinity profile 110 can be configured to transform the reciprocal motion of the piston 102 into the rotational motion of the power transfer shaft 103. In an example operation aspect, as the piston 102 reciprocates within the cylinder 101 along a travel path defined by the first pin end of the pin 120 and slot 115, the opposite second pin end of the pin 120 can be engaged with the infinity groove 110*a* of the power transfer shaft 103 and can urge the power transfer shaft 103 to rotate. In a further exemplary operational aspect, the shaft portion 103*a* can be configured to rotate as the power transfer shaft 103 rotates and can selectively engage the rotary valve 350 with the ports 241 of the power transfer shaft case 140.

Figure 5:
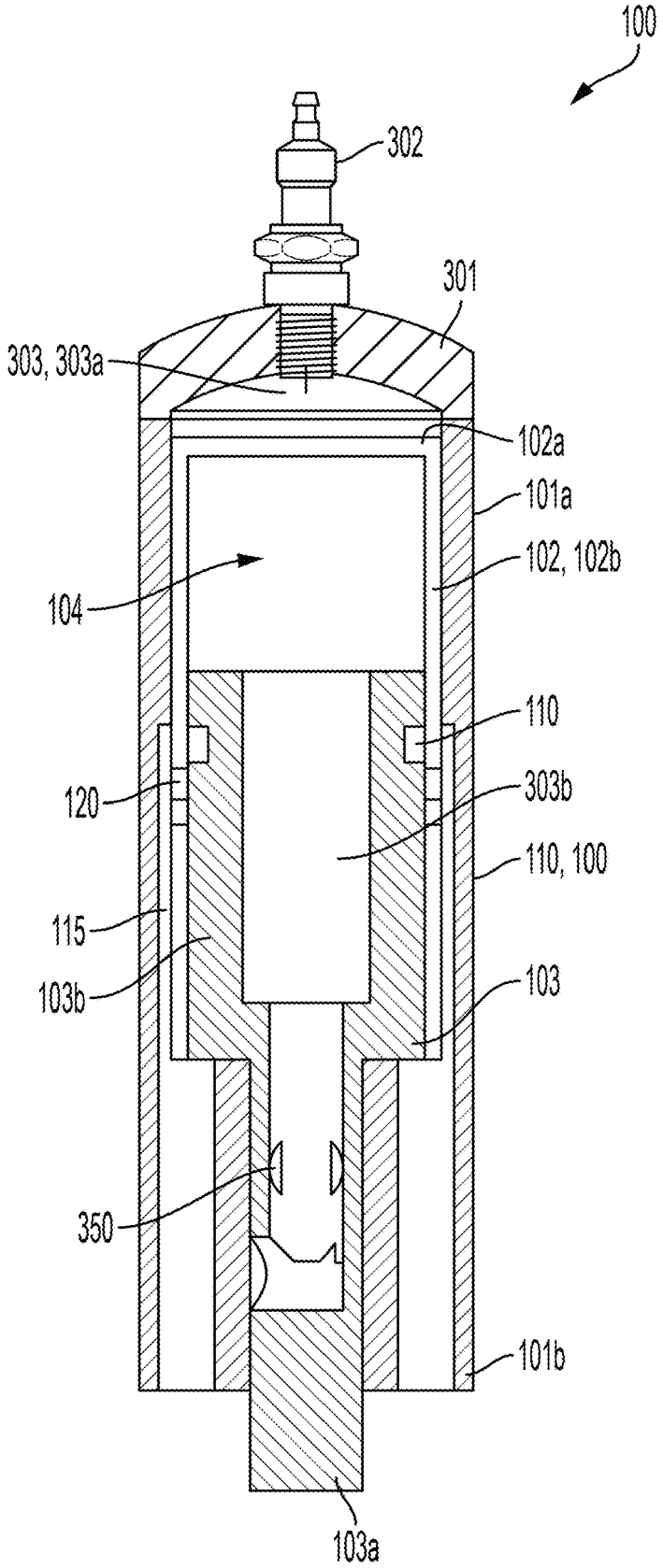
FIG. 5 is a cross sectional view of the multi-stage compression system, in accordance with another example aspect of the present disclosure.

Turning now to FIG. 5, a cross sectional view of the multi-stage compression engine 100 of FIG. 1 is illustrated in accordance with another aspect of the present disclosure. In example aspects, the multi-stage compression engine 100 can comprise the combustion chamber 303 which can be the first chamber 303*a*. The multi-stage compression engine 100 can comprise the second chamber 303*b*. In many aspects, the first chamber 303*a* can be fluidly coupled with the second chamber 303*b*. In some aspects, the working volume of one or both of the first chamber 303*a* and the second chamber 303*b* can be variable. In some aspects, the piston 102 can be configured to modulate the volume of any of the first chamber 303*a* and the second chamber 303*b*. In some aspects, the volume of the combustion chamber 303 does not change. In some aspects, the combustion chamber 303 can define a geometry which can be configured for flame propagation.

In example aspects, the first chamber 303*a* and/or the second chamber 303*b* can contain a gas. The piston 102 of the multi-stage compression engine 100 can be configured to interact with the gas or gasses. In some aspects, the gas can be configured to exert a force on the piston 102. In other aspects, the piston 102 can be configured to exert a force on the gas. In some aspects, one of the first chamber 303*a* or the second chamber 303*b* can be configured to contain a gas which the piston 102 exerts a force on, and the other chamber 303*a* or 303*b* can be configured to contain a gas which exerts a force on the piston 102. In some aspects, one of the first chamber 303*a* or the second chamber 303*b* can be configured to be a compression chamber, and the other chamber 303*a* or 303*b* can be configured to be a combustion chamber. In some aspects, the multi-stage compression engine 100 can be configured to compress a gas in either the first chamber 303*a* or second chamber 303*b*, transfer the compressed gas to the other chamber 303*a* or 303*b*, and initiate a combustion event. In some aspects, the multi-stage compression engine 100 can be configured to compress a gas in the first chamber 303*a* or second chamber 303*b*, transfer the compressed gas to the other chamber 303*a* or 303*b* and compress the gas during a second compression step, and initiate a combustion event.

Advantageously, the multi-stage compression engine 100 can be configured to compress a gas during two separate compression events. The multi-stage compression engine 100 can comprise a fuel injection mechanism (not shown). The fuel injection mechanism can be any of a carburetor, a fuel injector, a direct injection, a low pressure injector, a gas reservoir, a LNG injector, or the like. In some aspects, the multi-stage compression engine 100 can comprise one or more of the fuel injection mechanisms (not shown). In some aspects, the fuel injection mechanisms (not shown) can be configured to supply a fuel to the multi-stage compression engine 100. In some aspects, the multi-stage compression engine 100 can comprise two fuel injection mechanisms (not shown), each of which can be configured to perform a fuel injection step. In some aspects, the multi-stage compression engine 100 can be configured to perform two fuel injection events. In some aspects, the multi-stage compression engine 100 can be configured for a first fuel injection event, for example in the first chamber 303*a*, and a second fuel injection event, for example in the second chamber 303*b*. In some aspects, the multi-stage compression engine 100 can comprise one or more fuel injection mechanisms (not shown), each configured to inject a different fuel. In some aspects, some or all of the fuel injection mechanisms (not shown) can be configured to inject a hydrocarbon fuel. In some aspects, some or all of the fuel injection mechanisms (not shown) can be configured to inject a non-fossil-based fuel.

Figure 6:
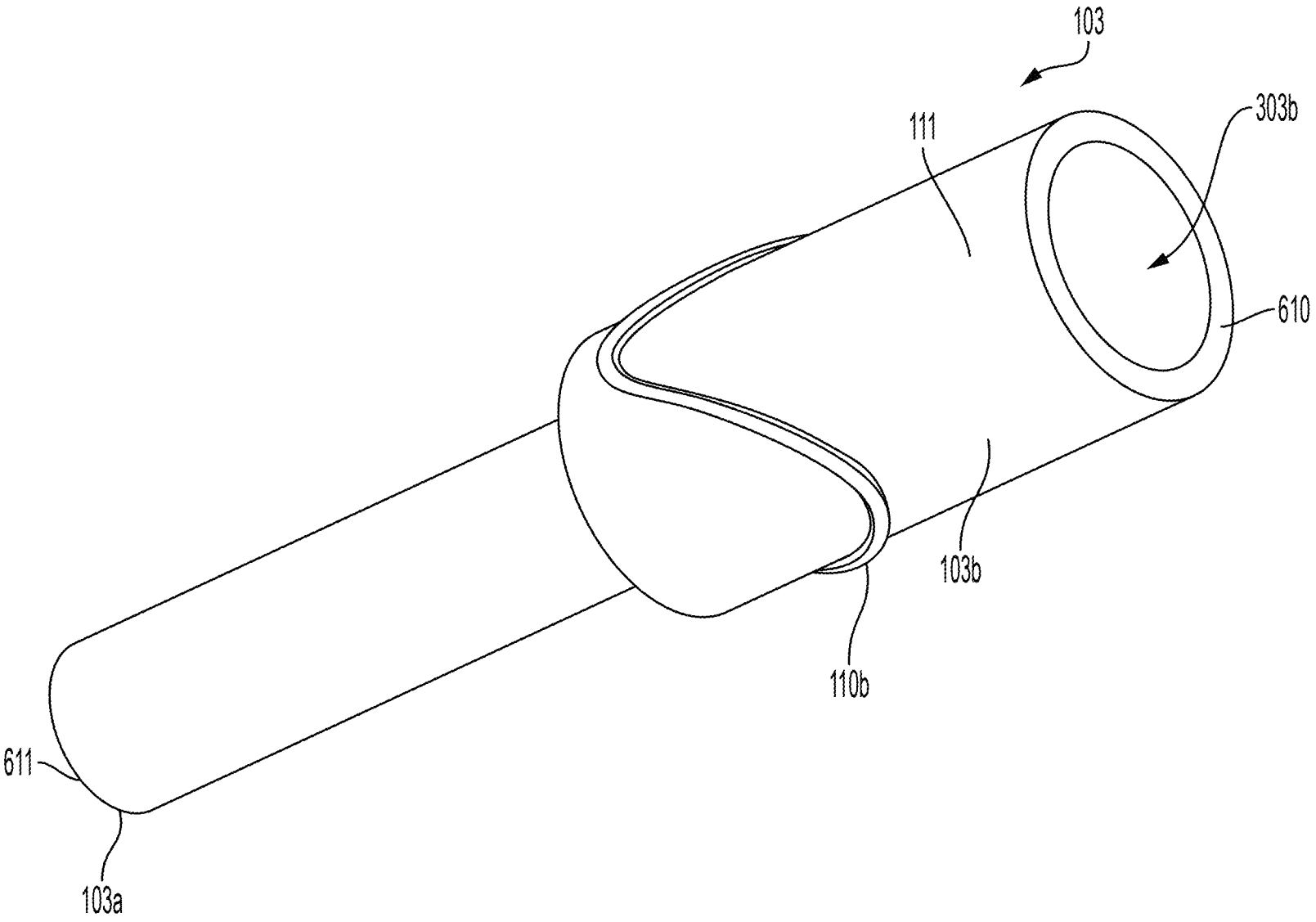
FIG. 6 is a perspective view of a power transfer shaft, in accordance with another example aspect of the present disclosure.

Turning now to FIG. 6, the power transfer shaft 103 of the multi-stage compression engine 100 of FIG. 1 in one aspect according to the present disclosure is shown and described. In some aspects, the power transfer shaft 103 can comprise a shaft proximal end 610 and a shaft distal end 611. The infinity portion 103*b* (which can be a ridged portion 103*b* in the present aspect) can define the shaft proximal end 610. The shaft proximal end 610 can define an opening into a hollow cavity that can define the second chamber 303*b*. The second chamber 303*b* can be configured for any of gas exchange, compression, combustion, or blowdown. In some aspects, the shaft distal end 611 can be defined by the shaft portion 103*a*. In some aspects, the shaft portion 103*a* can be configured to transmit a torque provided from the power transfer shaft 103.

The infinity portion 103*b* of the power transfer shaft 103 can define the infinity projection 110*b*, and more generally, the infinity profile 110. More specifically, in the present aspect, the ridged portion 103*b* can define the infinity ridge 110*b*. In some aspects, the infinity projection 110*b* can be a continuous projection which can be wrapped around a circumference of the infinity portion 103*b* of the power transfer shaft 103. In other aspects, the infinity projection 110*b* may comprise a plurality of spaced apart projection segments arranged in an infinity pattern. The infinity projection 110*b* can generally define a wave, such as a sine wave or any periodic wave, which can be continuously wrapped around the outer shaft surface 111 of the infinity shaft 103.

In some aspects, the infinity profile 110 can be the infinity projection 110*b* which can define a raised protrusion, such as the infinity ridge 110*b* shown. In other aspects, the infinity projection 110*b* can define any other suitable type of raised protrusion and may or may not wrap continuously about the infinity portion 103*b*. The infinity projection 110*b* and more generally, the infinity profile 110, can be configured to engage with the piston 102 (shown in FIG. 1). In example aspects, the infinity profile 110 can be configured to transform the reciprocal motion of the piston 102 to rotational motion.

In many aspects, the infinity profile 110 can be mechanically coupled to the piston 102 (shown in FIG. 1) and can define a travel path. The travel path can define the stroke length and stroke duration of the piston 102 (shown in FIG. 1). In many aspects, the infinity profile 110 can be changed based on the specific travel path desired. Moreover, the instantaneous piston speed, the stroke duration, and the number of strokes per revolution of power transfer shaft 103 can be adjusted based on the profile of the infinity profile 110 (e.g., the infinity projection 110*b* or the infinity groove 110*b*). For example and without limitation, the infinity profile 110 may be configured to allow the piston 102 to complete two strokes (as shown), four strokes, eight strokes, or more, per revolution of the power transfer shaft 103. In other aspects, the infinity profile 110 can allow the piston 102 to complete more or fewer strokes per revolution of the power transfer shaft 103 (e.g., eight strokes, for example and without limitation).

In some aspects, the multi-stage compression engine 100 can comprise one or more interchangeable power transfer shafts 103 each defining an infinity profile 110 defining a certain travel path for the piston 102. In an example aspect, a user can tune the piston motion dynamics of the piston 102 based on the selected power transfer shaft 103. For example only, and without limitation, if a user desires for the piston 102 to undergo more rapid acceleration during each stroke, the user can interchange a first power transfer shaft 103 with a second power transfer shaft 103 defining a second infinity profile, wherein the second infinity profile can define a travel path having the desired piston dynamics. In some aspects, the second infinity profile, like the infinity profile 110, can define a path substantially similar to an "infinity symbol" or "infinity sign" when arranged on a plane. In some aspects, a user may be able to interchange two or more differing grooved portions 103*b* on a standard and/or existing shaft portion 103*b* in order to selectively adjust the piston motion dynamics.

Figure 7:
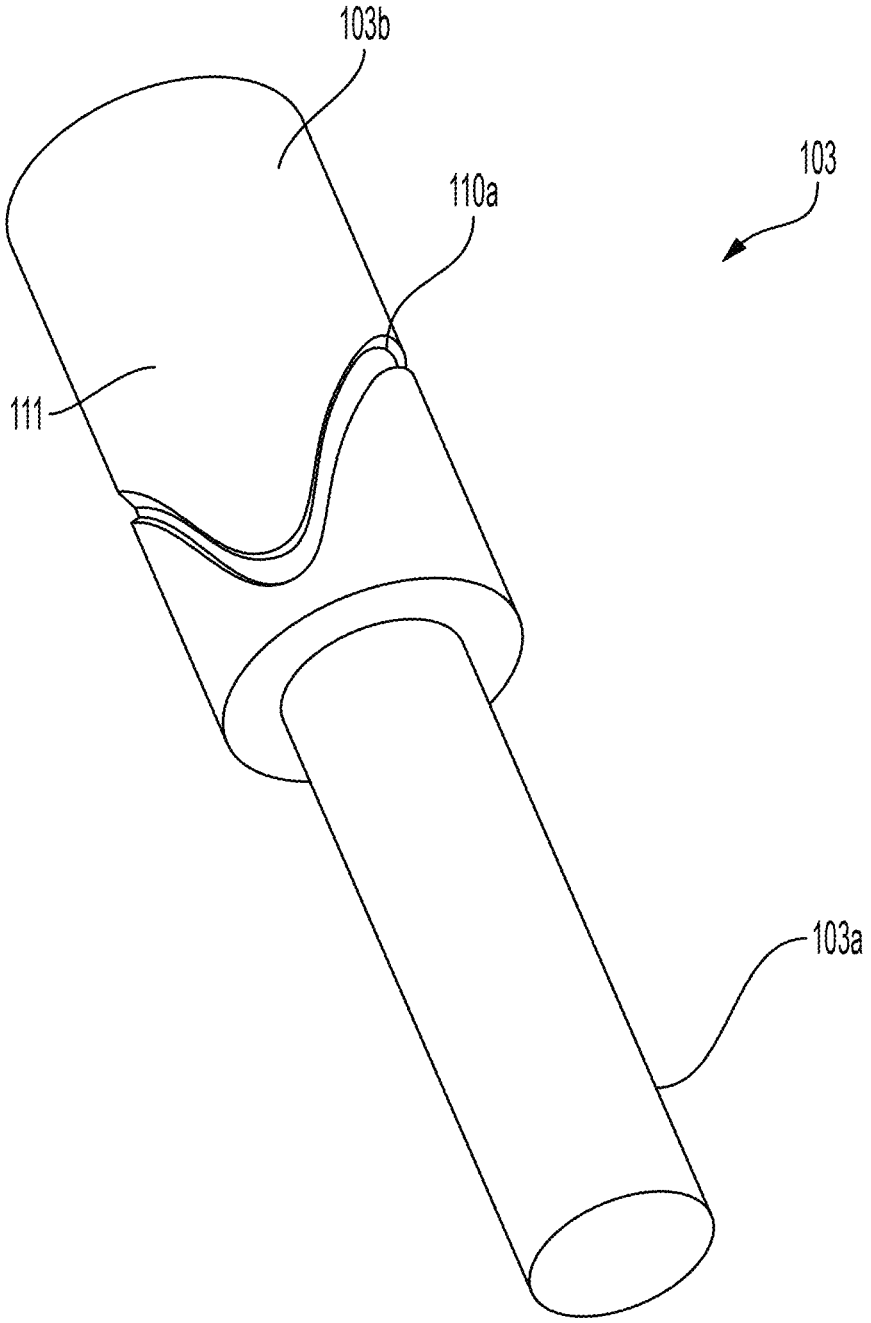
FIG. 7 is a perspective view of the power transfer shaft, in accordance with another example aspect of the present disclosure.

Turning now to FIG. 7, an alternative aspect of the power transfer shaft 103 is shown and described. In the present example aspect, the infinity profile 110 can comprise the infinity groove 110*a*. In example aspects, the infinity groove 110*a* can be a recession in the outer shaft surface 111 of the infinity portion 103*b* of the power transfer shaft 103. In some aspects, the infinity groove 110*a* can be configured to receive the pin 120 of the piston 102 (shown in FIG. 1) and provide mechanical communication between the power transfer shaft 103 and the piston 102. In some aspects, the infinity groove 110*a* can be configured to slidably receive the pin 120. The infinity groove 110*a* can be configured to receive the pin bearing 121. The pin bearing 121 can be configured to slide within the infinity groove 110*a*, and more generally the infinity profile 110. In some aspects, the infinity groove 110*a* may be utilized as the infinity profile 110 instead the infinity projection 110*b*, as it may provide a lower interference fit between the piston 102 and the power transfer shaft 103.

Figure 8:
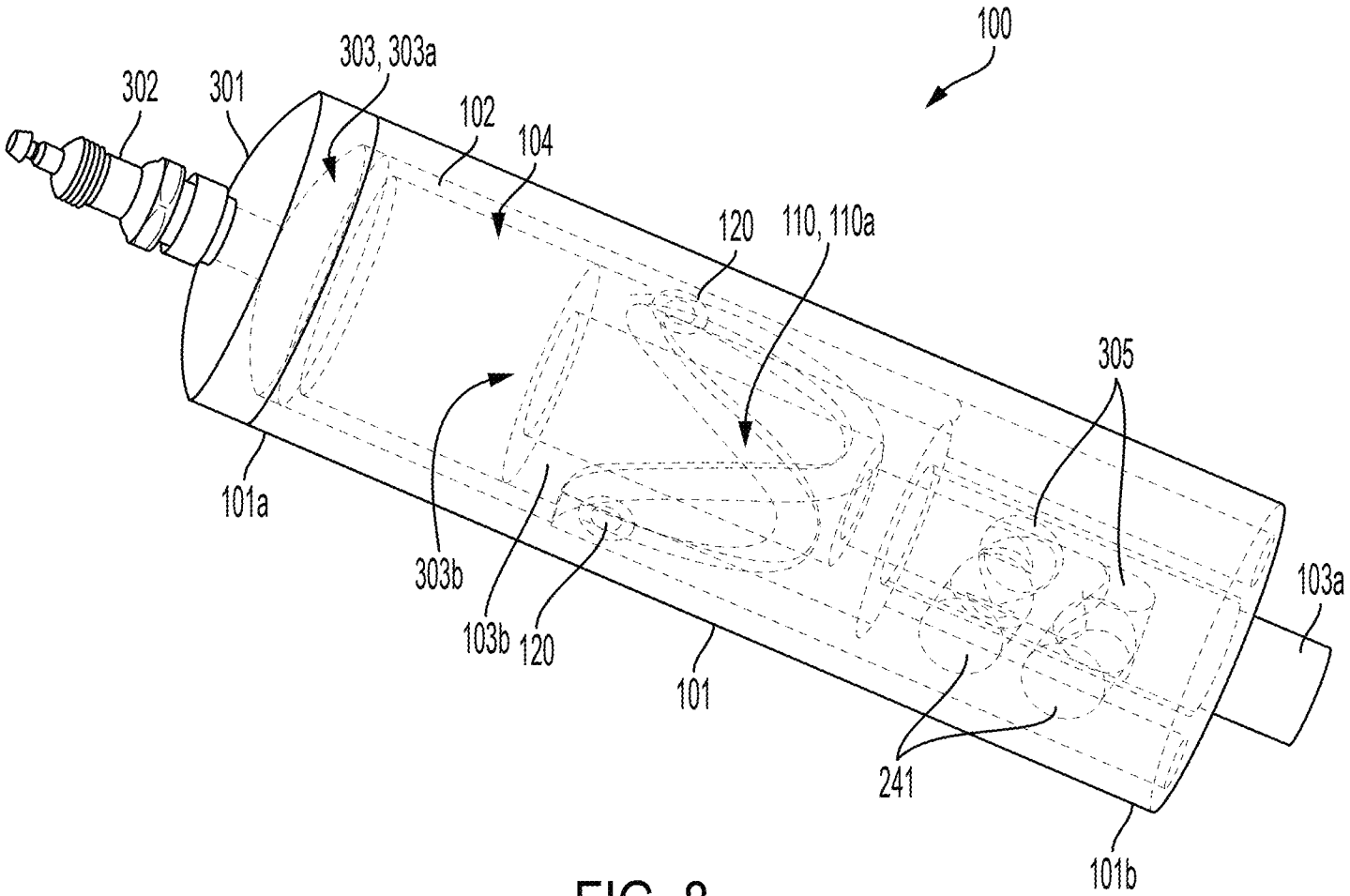
FIG. 8 is a perspective view of the multi-stage compression system, in accordance with another example aspect of the present disclosure.

Turning now to FIG. 8, an alternative aspect of the multi-stage compression engine 100 is shown and described. In some aspects, the multi-stage compression engine 100 can comprise the cylinder 101. The power transfer shaft 103 and the piston 102 can be movably connected to and housed within the cylinder 101. In some aspects, the piston 102 can be slidably connected to the cylinder 101 and can be configured to reciprocate in the cylinder 101. The piston 102 can be constrained to reciprocate within the cylinder 101 based on the interaction between the pins 120 and the slots 115 defined in the cylinder 101. More specifically, the first pin ends of the pins 120 can engage the slots 115 of the cylinder 101 and can constrain the piston 102 to a reciprocal path defined by the slots 115.

The multi-stage compression engine 100 can comprise the power transfer shaft 103. The power transfer shaft 103 can be rotatably disposed within the piston bore 104 and rotatably connected to the piston 102. The power transfer shaft 103 can be configured to rotate within the piston bore 104. In some aspects, the piston 102 can mechanically engage the power transfer shaft 103 at the second pin end of the pin 120. The second pin end of the pin 120 can be slidably received by the power transfer shaft 103. More specifically, the second pin end of the pin 120 can be slidably connected to the power transfer shaft 103 by being received by the infinity groove 110*a* of the infinity profile 110. The pin 120 can be configured to translate within the infinity groove 110*a* relative to the power transfer shaft 103 in more than one axis. For example, the pin 120 can follow a biaxial travel path within the infinity groove 110*a*, relative to the power transfer shaft 103. The pin 120 can define a pin body which can extend through the piston 102. In many aspects, the reciprocation of the piston 102 can be transformed into rotation of the power transfer shaft 103 based on the combination of the piston 102, the pin 120, the slots 115 in the cylinder 101, and the infinity profile 110 of the power transfer shaft 103.

Figure 9:
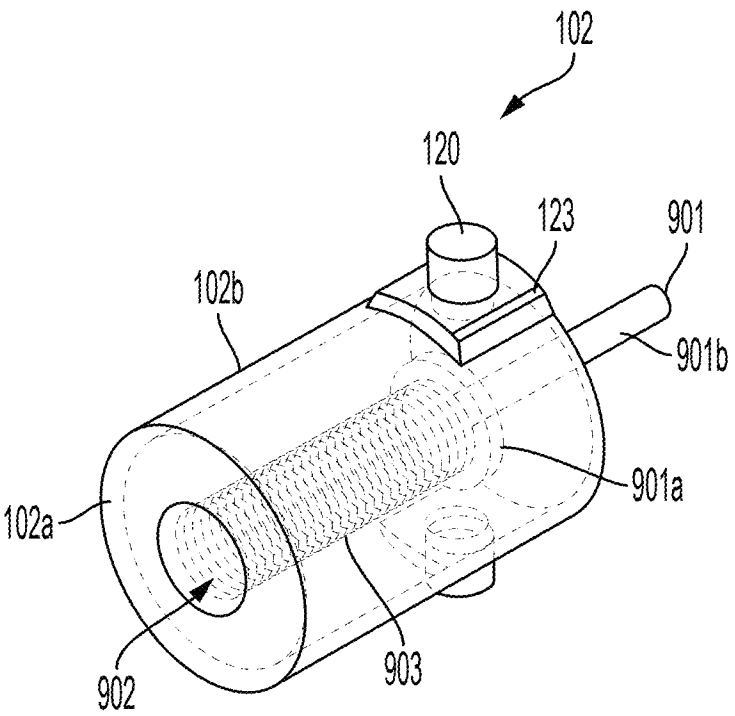
FIG. 9 is a perspective view of a pair of pistons, in accordance with another example aspect of the present disclosure.
Figure 9:
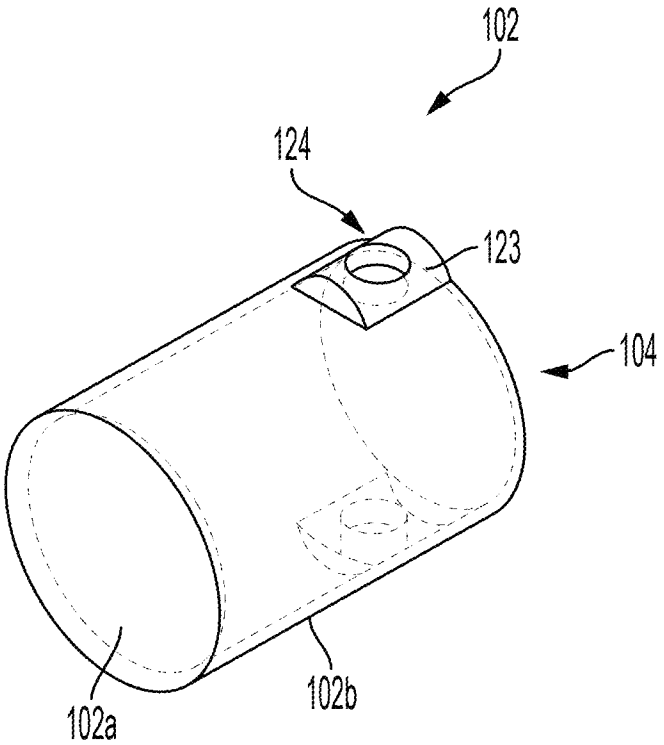

Turning now to FIG. 9, a schematic view of two alternative aspects of pistons 102 of the multi-stage compression engine 100 are shown and described. In some aspects, the piston 102 can comprise the piston crown 102*a* and the piston skirt 102*b*. The piston 102 can comprise the pin boss 123 on the skirt 102*b* of the piston 102. In some aspects, the pin boss 123 can be configured to be received by the infinity profile 110. In some aspects, the pin boss 123 can define the pin boss hole 124. The pin boss hole 124 can be a through hole disposed in the pin boss 123. The pin boss hole 124 can be configured to receive the pin 120. In some aspects, the pin 120 can be received by the pin boss hole 124 by, for example and without limitation, an interference fit or can be coupled thereto by any suitable fastener. In other aspects, the pin 120 can be integrally formed with the skirt 102*b* of the piston 102, can be monolithically formed (i.e., formed a singular component that constitutes a single material without joints or seams) with the skirt 102*b* of the piston 102, or can be attached thereto by any other suitable fastener or fastening technique.

In some aspects, the piston 102 can comprise a piston port 902. The piston port 902 can be a hole which can extend partially or completely through the piston 102. The piston port 902 can be configured for gas exchange and can be in selective fluid communication with any portion of the multi-stage compression engine 100. In some aspects, the piston port 902 can be in fluid communication with the rotary valve 350 and/or ports 241, the first chamber 303*a*, the second chamber 303*b*, the piston bore 104, or the cylinder bore 105 or any part of the multi-stage compression engine 100. In some aspects, the piston port 902 can comprise a push valve 901. The push valve 901 can be an elongated member, such as a push rod, defining a push valve head 901*a* and a push valve stem 901*b*. In some aspects, the push valve 901 can be disposed in the piston port 902. The push valve 901 can be configured to selectively modulate an opening of the piston port 902. In some aspects, the push valve 901 can be configured to selectively continue or discontinue fluid communication between the piston port 902 and any of, for example, rotary valve 350 and/or ports 241, the first chamber 303*a*, the second chamber 303*b*, the piston bore 104, or the cylinder bore 105, or any part of the multi-stage compression engine 100. In some aspects, the piston 102 can comprise a valve spring 903. The valve spring 903 can be configured to bias the push valve 901. The valve spring 903 can be disposed proximal to the push valve head 901*a* and can be configured to urge or bias the push valve 901 in a direction. In some aspects, the valve spring 903 can be configured to retain the push valve 901 in a certain orientation. For example, and without limitation, the valve spring 903 can be configured to retain the push valve 901 in a closed position when not engaged.

A method of use of the multi-stage compression engine 100 can comprise providing the multi-stage compression engine 100. A method of use of the multi-stage compression engine 100 could comprise providing any part of the multi-stage compression engine 100. In some aspects, method of use of the multi-stage compression engine 100 could comprise operating the multi-stage compression engine 100, wherein the piston 102 can reciprocate which can result in the rotation of the power transfer shaft 103, including the shaft portion 103*a*. According to example aspects, depending upon the profile of the infinity groove 110*a* or the infinity projection 110*b*, the piston 102 can be configured to reciprocate multiple times (for example, two times, four times, eight times, or any other suitable number of reciprocations) per revolution of the power transfer shaft 103. In some aspects, the method can comprise transferring a gas throughout the multi-stage compression engine 100. In some aspects, the method can comprise connecting the shaft portion 103*a* of the power transfer shaft 103 of the multi-stage compression engine 100 to an external mechanism, such as a dynamo, a transmission, a vehicle, a power implement, or the like. In some aspects, the method can comprise generating power with the multi-stage compression engine 100. In other various aspects, some methods can comprise compressing a gas (such as air, a noble gas, or a refrigerant, for example) with the multi-stage compression engine 100. In some aspects, the method can comprise completing a thermodynamic cycle with the multi-stage compression engine 100. In some aspects, the method can comprise completing a heat cycle with the multi-stage compression engine 100.

In example aspects, the method can comprise a fuel induction event. The fuel induction event can take place, for example, by way of the any of the ports 241 or rotary valves 350. The fuel induction event can comprise inducting any suitable fluid (such as a fuel, a gas, or air, for example) into the multi-stage compression engine 100. Such inducted elements or combination of elements can comprise a charge. In some aspects, methods of use of the multi-stage compression engine 100 can comprise transferring the charge to any portion of the multi-stage compression engine 100. In some aspects, the method can comprise transferring the charge to either the first or second chamber 303*a*,303*b*. The method can comprise transferring the charge to the first chamber 303*a* in example aspects. The charge can be compressed by the piston 102 as it travels towards the combustion chamber 303 in the cylinder head 301. Some methods can comprise generating an ignition event with the sparkplug 302. The ignition event can increase the temperature and pressure of the charge. In some aspects, the method can comprise capturing the expansion work of the ignited charge with the multi-stage compression engine 100. In some aspects, methods can comprise utilizing the pressure rise of the combustion charge to force the piston 102 away from the combustion chamber 303. The multi-stage compression engine 100 can be configured to transform the forced motion of the piston 102 into rotational work.

In some aspects, the multi-stage compression engine 100 can be a two-stroke compression engine requiring two strokes of the piston 102 to complete combustion. In other aspects, the multi-stage compression engine 100 can be a four-stroke engine requiring four strokes of the piston 102 to complete combustion. Such a two-stroke compression engine can utilize the piston 102 to cover and uncover various ports (e.g., the intake and exhaust ports 241) for intake and exhaust, as previously described. Such a four-stroke compression engine can comprise various valves for intake and exhaust. For example, the four-stroke compression engine may comprise poppet valves, rotary valves, and/or any other suitable type of valve known in the art. In other aspects, the infinity profile 110 of the multi-stage compression engine 100 can be configured to allow the piston 102 to complete any suitable number of strokes (e.g., two, four, eight, etc.) per revolution of the power transfer shaft 103. In various configurations of the multi-stage compression engine 100, the piston 102 can reciprocate to cover and uncover various ports (e.g., the intake and exhaust ports 241) for intake and exhaust. In various configurations of the multi-stage compression engine 100, various valves can be provided (such as at the ports 241 and/or at the crown 102*a* of the piston 102, for example and without limitation) for intake and exhaust.

In some aspects, the method can comprise a multi compression step, such as a dual compression step, for example. In an example aspect, the dual compression step can comprise inducing the charge into either the first or second chamber 303*a*,303*b* and compressing the charge. The compressing can be accomplished by the piston 102 decreasing the volume of the first or second chamber 303*a*,303*b*. After the first compression, the compressed charge can be transferred to the other chamber 303*a* or 303*b*. For example, if the charge was first compressed in the first chamber 303*a*, the other chamber would be the second chamber 303*b*. In some aspects, the compressed charge can be transferred to the other chamber. The compressed charge can be compressed during a second compression step. Advantageously, the second compression step can increase the thermodynamic efficiency of the multi-stage compression engine 100 relative to a single compression-step engine. In some aspects, the method can comprise capturing the dual compressed charge, for example in a compressed air tank. In other aspects, the method can comprise the ignition event, wherein the ignition event is configured to encourage a chemical reaction, such as a combustion reaction, in the dual compressed charge. In some aspects, the method can comprise a first ignition event and a second ignition event. For example and without limitation, a method of use can comprise compressing the charge in a first compression step in the first or second chamber 303*a,b*, and subsequently, combusting the charge, transfer the products of combustion to the other one of the first or second chamber 303*a,b*, compressing the combusted charge in a second compression step, introducing a second fuel, and initiating a second combustion event. In some aspects, methods of use can comprise expelling the products of combustion external to the multi-stage compression engine 100.

In some aspects, a method of use of the multi-stage compression engine 100 can comprise providing a power transfer shaft 103. In some aspects, methods of use can comprise defining a travel path for the piston 102 with the power transfer shaft 103. In some aspects, methods can comprise defining a travel path for the piston 102 with the infinity profile 110. In some aspects, the method can comprise modulating the travel path. The travel path can be defined by the profile of the infinity profile 110. In some aspects, methods can comprise altering the travel path of the piston 102 based on the infinity profile 110. In an illustrative example, a method can comprise the step of defining a first travel path of the piston 102 with a first power transfer shaft 103 defining a first infinity profile 110. The first infinity profile 110 can define a first travel path. The example method can comprise replacing the first power transfer shaft 103 with a second power transfer shaft 103. The second power transfer shaft 103 can define a second infinity profile 110. The second infinity profile 110 can define a second travel path. The method can comprise modifying the piston travel path, and more generally the piston dynamics based on the infinity profile 110 of the selected first or second power transfer shaft 103.

In some aspects, the multi-stage compression engine 100 can be configured to provide naturally aspirated, multiple power strokes of the piston 102 per revolution of the power transfer shaft 103 and supercharging of the intake without an additional or external compressor. For example, a compression step can comprise moving the piston 102 through an intake stroke (i.e., an upstroke), wherein the piston 102 can move upward from a bottom dead center position to a top dead center position. The travel of the piston 102 through the intake stroke can compress a first supercharged fuel/air mixture that was previously injected into a combustion chamber.

Simultaneously, the upward movement of the piston 102 can create a vacuum in the power transfer shaft case 140 that can utilize a valve (such as the rotary valve 350 or a one-way reed valve, for example and without limitation) to draw a fresh, second mixture of air and fuel into the power transfer shaft case 140 and a compression chamber.

At the top dead center position of the piston 102, the compressed supercharged fuel/air mixture in the combustion chamber can be ignited, and the combustion can force the piston 102 back downward through a power stroke. The power stroke can rotate the power transfer shaft 103. Moreover, the downward movement of the piston 102 can compress the second air/fuel mixture in the power transfer shaft case 140 and compression chamber, creating a high pressure therein and having a supercharging effect on the second air/fuel mixture.

As the piston 102 moves downward to reach the bottom dead center position, the exhaust port 241 can be opened to empty burnt gasses from the cylinder 101, creating a suction within the cylinder 101. The suction can allow the second supercharged air/fuel mixture in the power transfer shaft case 140/compression chamber to pressurize the combustion chamber, and the second supercharged air/fuel mixture can be introduced to the combustion chamber via the exhaust port 241. In example aspects, the combustion chamber can be pressurized to between about 30 and 60 psi. In other aspects, the combustion chamber can be pressurized to more or less than 30 and 60 psi.

Depending upon the configuration of the infinity profile 110, the multi-stage compression engine 100 can complete multiple power cycles (e.g., 2, 4, etc.) per revolution of the power transfer shaft 103. For example and without limitation, in one particular aspect, the multi-stage compression engine 100 may complete 2 power cycles with 4 strokes of the piston 102 in a single revolution of the power transfer shaft 103. In another example aspect, the multi-stage compression engine 100 may complete 4 power cycles with 8 strokes of the piston 102 in a single revolution of the power transfer shaft 103.

Figure 10:
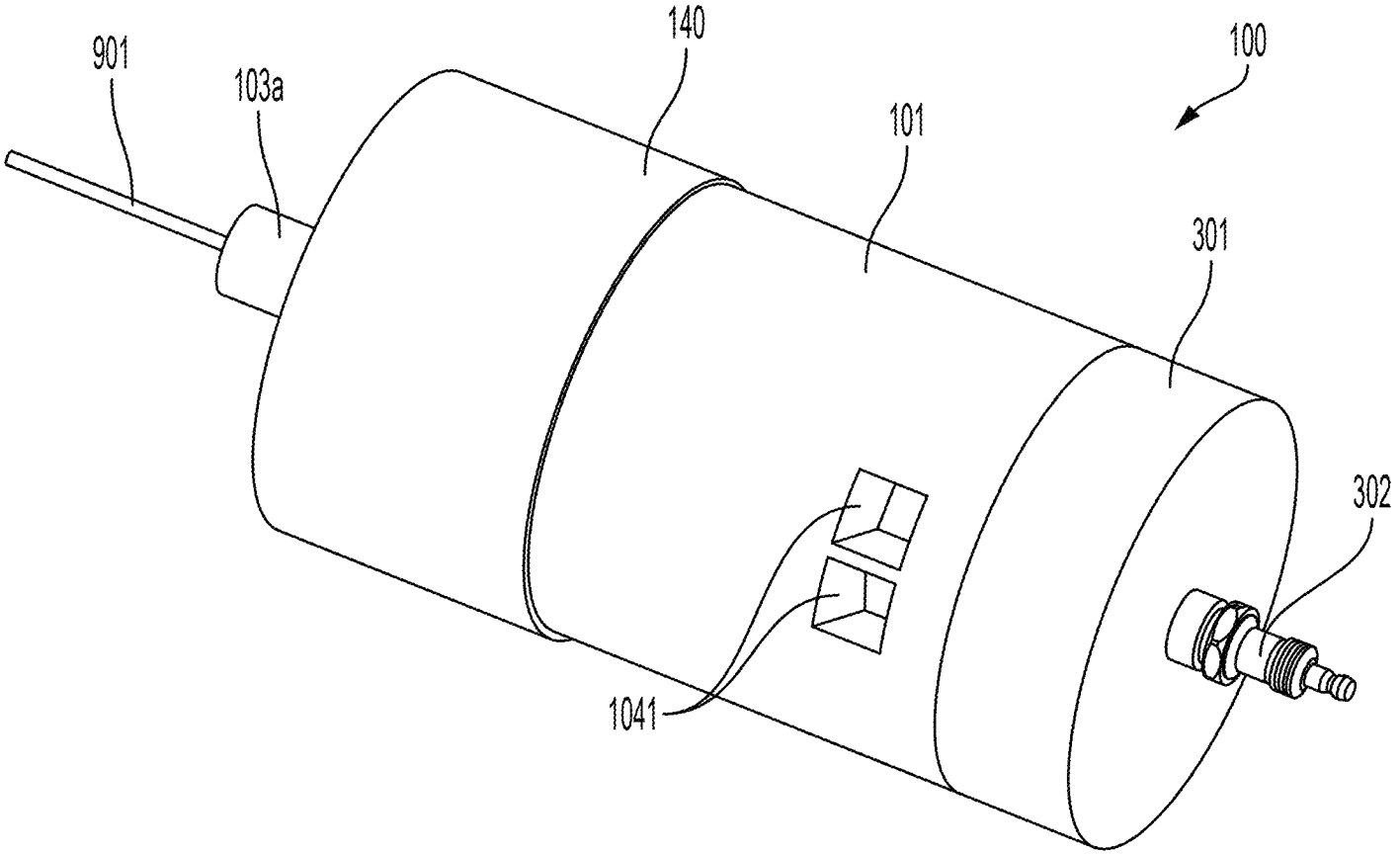
FIG. 10 is a perspective view of the multi-stage compression system, in accordance with another example aspect of the present disclosure.
Figure 11:
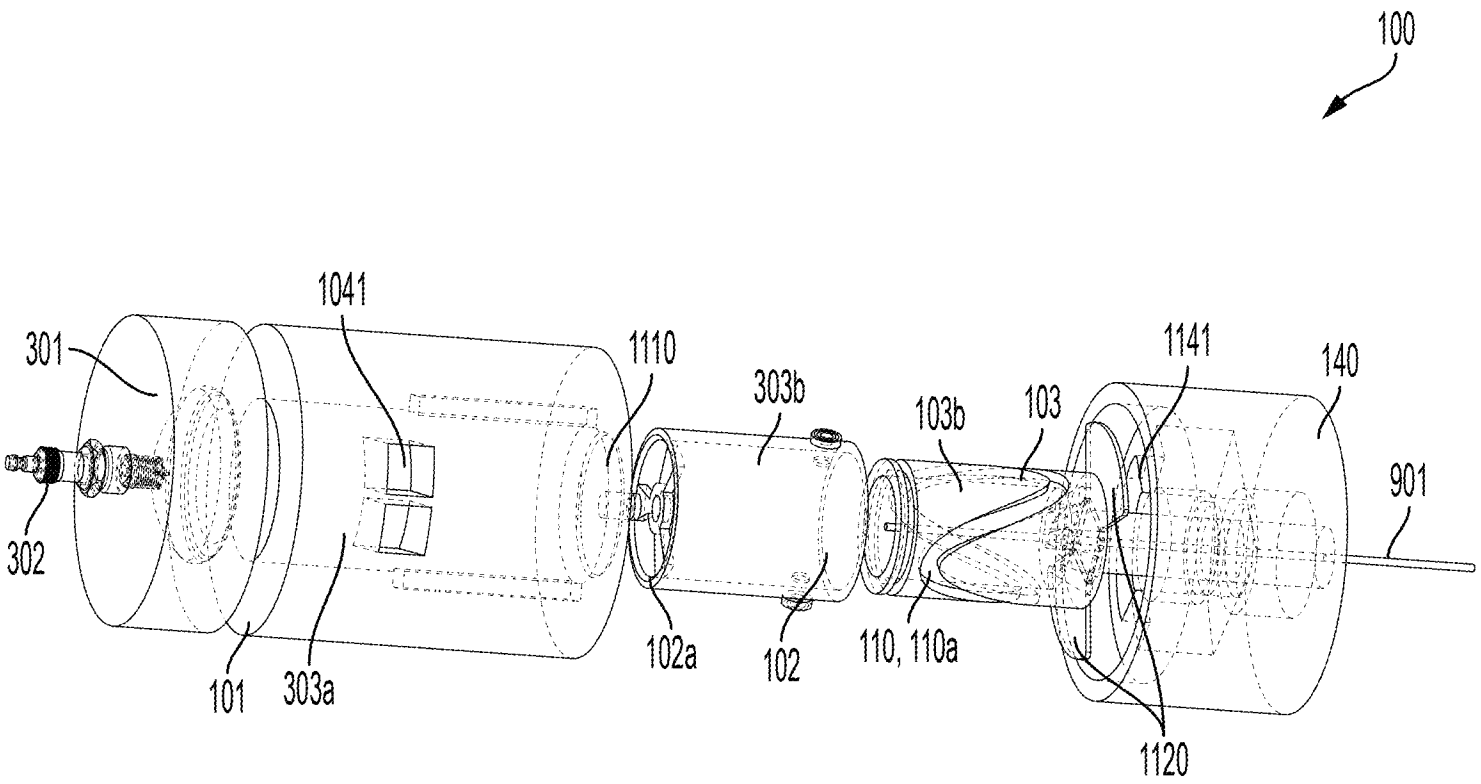
FIG. 11 is a perspective exploded view of the multi-stage compression system of FIG. 10.

FIG. 10 shows another aspect of the multi-stage compression engine 100. As shown in FIG. 10, the engine 100 can further comprise a push valve 901, which can be a piston valve actuator and/or a push rod, which can be a line extending through the shaft portion 103*a* of the power transfer shaft 103. As shown in FIG. 11, the push valve 901 can extend through the power transfer shaft 103, through the second chamber 303*b*, and to a piston valve 1110 mounted in the piston crown 102*a* of the piston 102. The piston valve 1110 can be moved by the push valve 901 to selectively open and close a passageway defined in the piston crown 102*a* of the piston 102 to allow fluid (e.g., gas) to flow from the second chamber 303*b* to the first chamber 303*a*. That is, the piston valve 1110 can be closed for compression of the fluid (e.g., gas) within the second chamber 303*b* and opened to allow for the release of the compressed fluid into the first chamber 303*a*. The piston 102 can be cam-driven, solenoid-driven, or driven by any other suitable drive mechanism, as will be appreciated by one of ordinary skill in the art.

Figure 13:
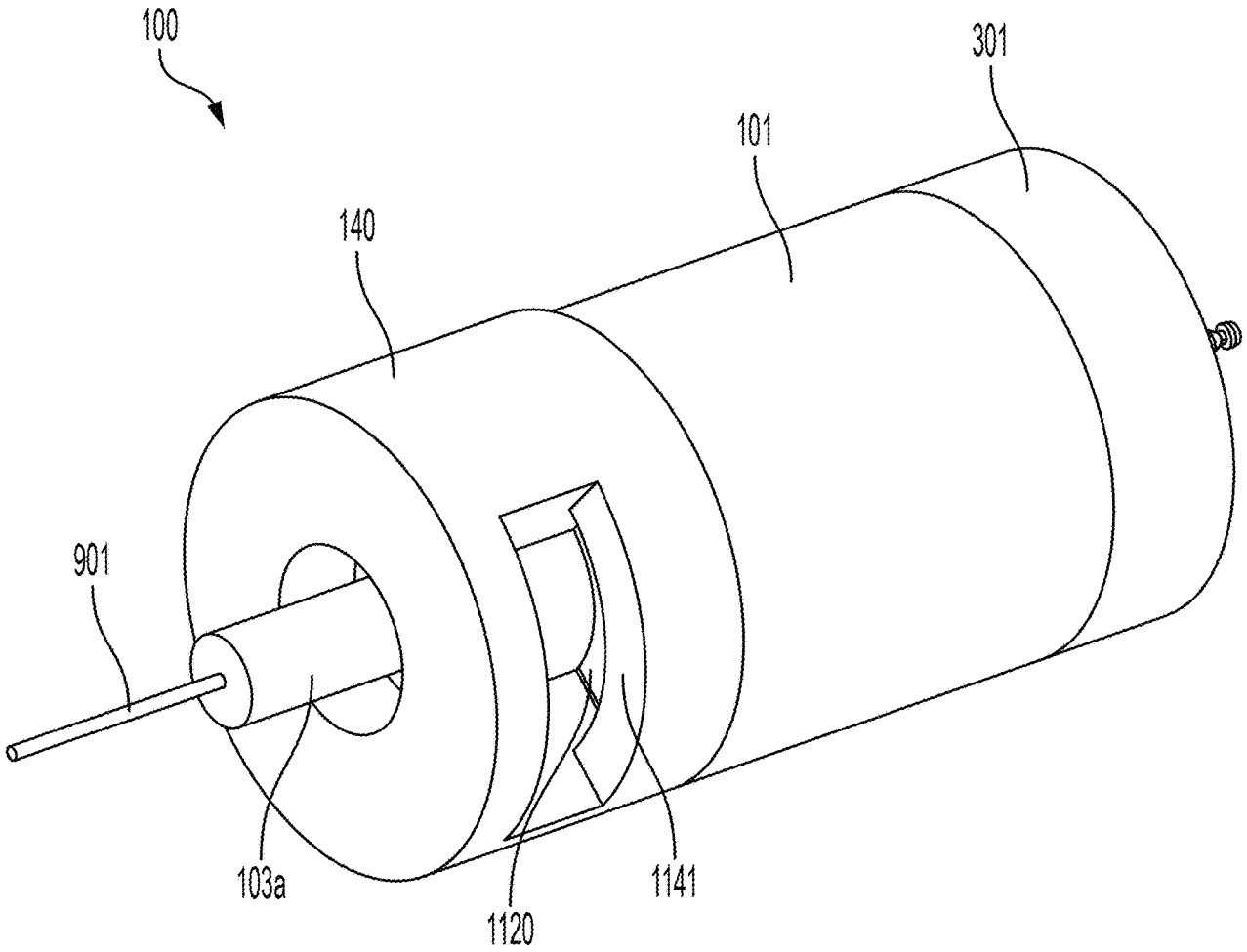
FIG. 13 is another perspective view of the multi-stage compression system of FIG. 10.

Further, the cylinder 101 can define an exhaust port 1041 for venting exhaust from the first chamber 303*a* after a combustion event. The power transfer shaft case 140 can define an intake port 1141 for injection of fuel into the engine 100. The power transfer shaft 103 can further comprise a rotary valve 1120 that can selectively cover and uncover the intake port 1141 as power transfer shaft 103 turns, thereby controlling when fuel is injected into the multi-stage compression engine 100. As shown, the rotary valve 1120 can be defined as a pair of wings on opposite sides of the power transfer shaft 103. In other aspects, the rotary valve 1120 can comprise any other suitable number of wings. As shown in FIG. 13, the intake port 1141 can be defined entering into a side of the power transfer shaft case 140 and extending upwards towards the second chamber 303*b*. The rotary valve 1120 is shown in FIG. 13 covering the intake port 1141.

In the present aspect, the rotary valve 1120 can be mounted to the shaft portion 103*a* of the power transfer shaft 103, as shown. In other aspects, such a rotary valve 1120 can also or alternatively be mounted at any other suitable location within the multi-stage compression engine 100 (or pump or compressor), to selectively permit and prohibit fluid flow therethrough as the power transfer shaft 103 (or another rotating component) rotates. In example aspects, the rotary valve 1120 can can be configured to open and close to selectively continue or discontinue fluid transfer, and/or to increase pressure within the power transfer shaft case 140 (or another chamber) to supercharge an air/fuel mixture therein.

Figure 12:
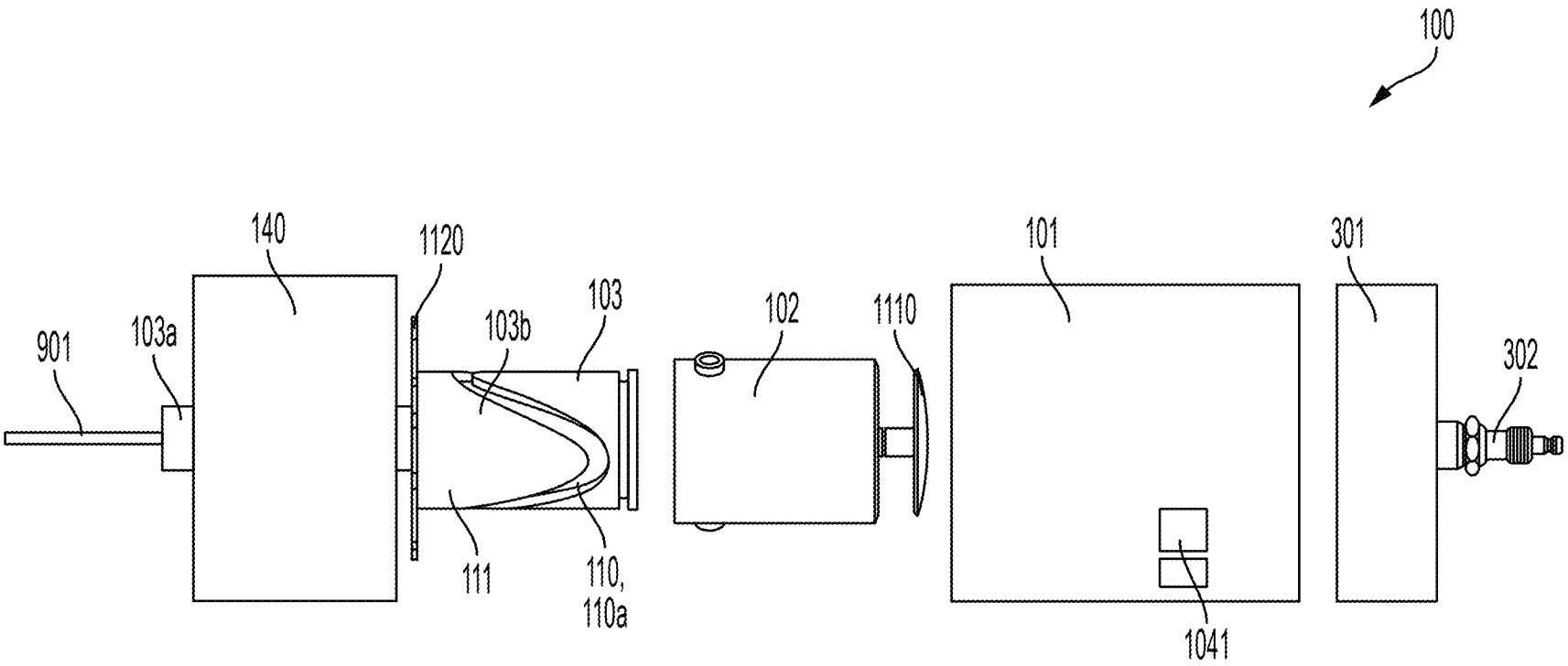
FIG. 12 is a side exploded view of the multi-stage compression system of FIG. 10.
Figure 14:
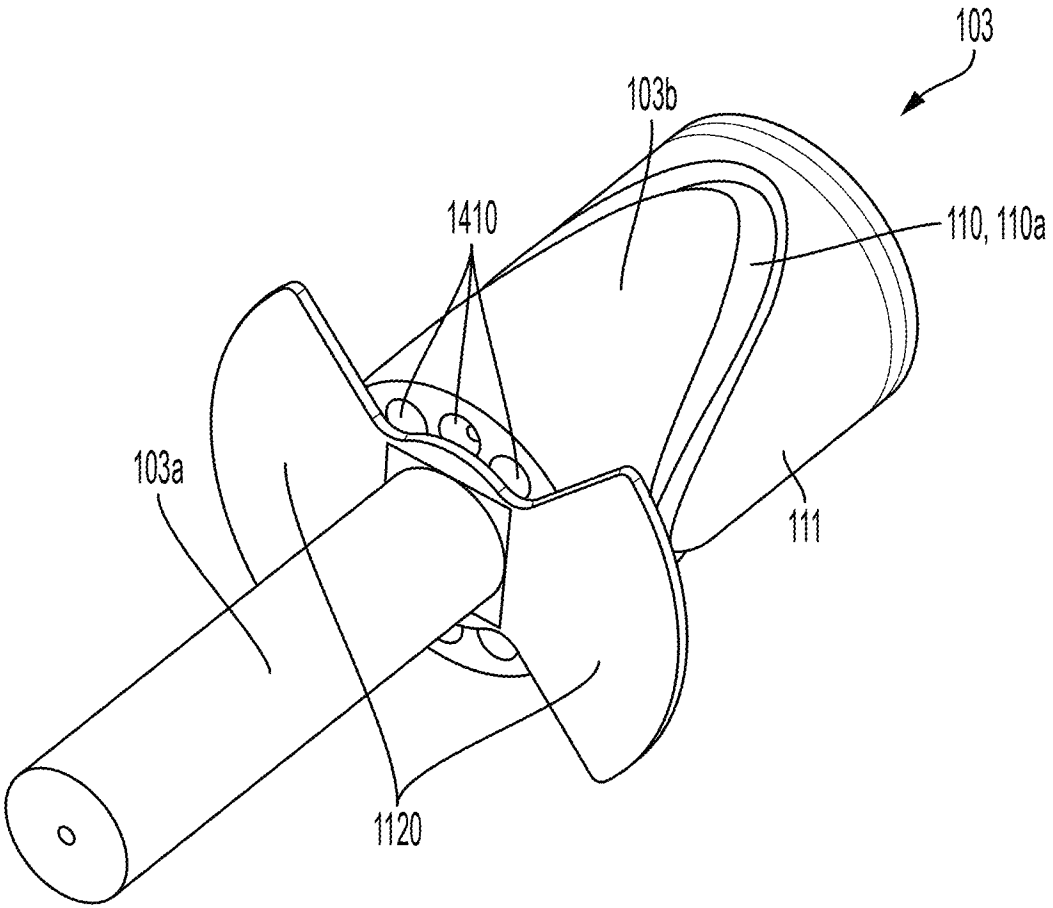
FIG. 14 is a perspective view of the power transfer shaft of the multi-stage compression system of FIG. 10, the power transfer shaft comprising a rotary valve.

FIG. 12 shows an exploded side view of the multi-stage compression engine 100. FIG. 14 shows a perspective view of the power transfer shaft 103. As shown in FIG. 14, the power transfer shaft 103 can define a plurality of fluid bores 1410 (similar to fluid bores 112 shown in FIG. 1) between the wings defined by the rotary valve 1120. The fluid bores 1410 allow fluid communication between the second chamber 303*b* and the intake port 1141 when the rotary valve 1120 is not covering the intake port 1141. In other aspects, the fluid bores 1410 can be formed as slots or any other suitable opening.

Figure 15:
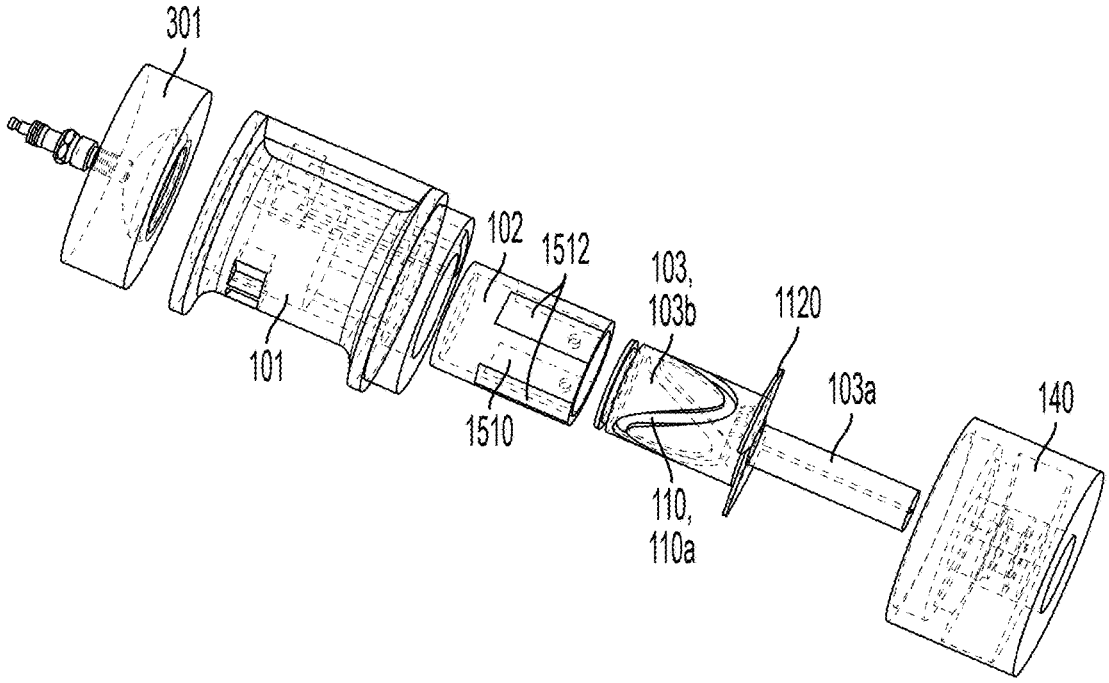
FIG. 15 is an exploded view of the multi-stage compression system, in accordance with another example aspect of the present disclosure.
Figure 16:
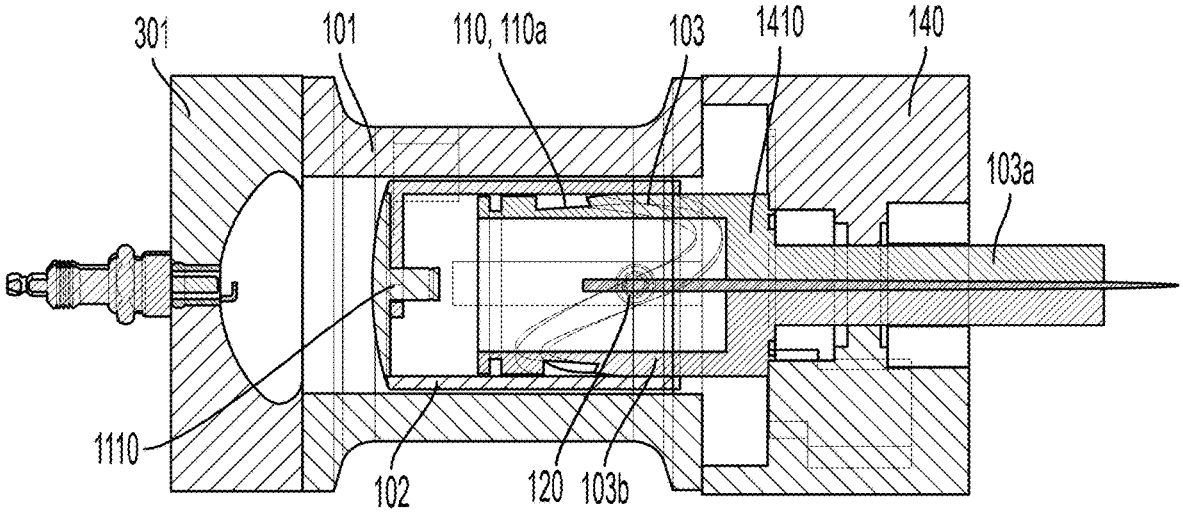
FIG. 16 is a cross-sectional view of the multi-stage compression system of FIG. 15.

FIGS. 15 and 16 illustrate exploded and cross-section views, respectively, of another example aspect of the multi-stage system, which can be a multi-stage compression engine 100 in the present aspect. In FIG. 16, the power transfer shaft 103 is shown in transparency for visibility of the infinity profile 110 and the pin 120. The multi-stage compression engine 100 can be a two-stroke compression engine 100, as shown. As previously described, in other aspects, the multi-stage system can be a compression engine, a compressor, or a pump, for example and without limitation, wherein the piston 102 can achieve multiple strokes per revolution of power transfer shaft 103. For example and without limitation, the piston 102 may achieve two strokes, four strokes, or any other suitable number of strokes per revolution.

The multi-stage compression engine 100 can comprise the cylinder 101, the cylinder head 301, the piston 102, the power transfer shaft 103, and the power transfer shaft case 140. The power transfer shaft 103 can comprise the shaft portion 103*a* and the infinity portion 103*b*. The infinity portion 103*b* can define the infinity profile 110, which can be the infinity groove 110*a* in the present aspect. The rotary valve 1120 can be mounted to the shaft portion 103*a*.

In the present aspect, an outer piston surface 1510 of the piston 102 can define one or more of the planar portions 1512. The planar portions 1512 can extend from the distal piston end towards the proximal piston end. In the present aspect, the planar portions 1512 do not extend fully along a length of the piston 102. In other aspects, the planar portions 1512 can extend fully along the length of the piston 102. The planar portions 1512 of the piston 102 can be configured to interact with a corresponding anti-rotation feature(s) of the cylinder 101, such as corresponding planar portions of the cylinder bore 105 (shown in FIG. 1). Each of the planar portions of the cylinder bore 105 can serve as a bearing surface on which the planar portions 1512 of the piston 102 can slide to reduce friction and limit wear on the components.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A multi-stage system, comprising:

a cylinder, the cylinder comprising an inlet thereto and an outlet therefrom;

a power transfer shaft configured for rotation within the cylinder, the power transfer shaft comprising a shaft portion and an infinity portion; and a piston configured to reciprocate within the cylinder, the piston defining a first compression chamber and a second compression chamber within the cylinder, wherein the first compression chamber is defined between the cylinder and the piston and wherein the second compression chamber is defined between the piston and the power transfer shaft;

wherein:

one of the infinity portion of the power transfer shaft or the piston defines an infinity profile;

the other one of the infinity portion of the power transfer shaft or the piston slidably engages the infinity profile;

the first compression chamber is configured to either:

receive a first fuel therein from a first fuel injection event and to complete a first thermodynamic cycle with the first fuel; or receive a first charge therein from a first charge induction event and to complete either a first compression cycle or a first pumping cycle with the first compression charge; and the second compression chamber is configured to either:

receive a second fuel therein from a second fuel injection event and to complete a second thermodynamic cycle with the second fuel; or receive a second charge therein from a second charge induction event and to complete a second compression cycle or a second pumping cycle with the second compression charge.

2. The multi-stage system of claim 1, wherein the infinity profile is configured to define a piston travel path and alter motion of the piston.

3. The multi-stage system of claim 2, wherein the infinity profile is a wrapped sinusoidal groove.

4. The multi-stage system of claim 3, wherein the other of the infinity portion of the power transfer shaft or the piston comprises a pin configured to slidably engage the wrapped sinusoidal groove.

5. The multi-stage system of claim 4, wherein the cylinder defines a linear cylinder slot disposed axially between the inlet and the outlet, and wherein the pin further slidably engages the linear cylinder slot.

6. The multi-stage system of claim 5, wherein the infinity profile, the pin, and the linear cylinder slot are configured to, in combination, either transform reciprocal motion of the piston into rotational motion of the power transfer shaft or transform rotational motion of the power transfer shaft into reciprocal motion of the piston.

7. The multi-stage system of claim 5, wherein the cylinder further comprises an intake valve and an exhaust valve, and the intake valve and exhaust valve are in selectable fluid communication with the cylinder.

8. The multi-stage system of claim 2, wherein the infinity profile is a wrapped sinusoidal projection.

9. The multi-stage system of claim 1, wherein the multi-stage system further comprises one or more valves configured for gas exchange.

10. The multi-stage system of claim 1, further comprising an ignition source defined in the cylinder and configured to selectively generate an ignition event involving a fuel charge.

11. The multi-stage system of claim 1, wherein at least one of the first compression chamber and the second compression chamber are configured for at least one of: expansion work polytropic expansion, isochoric combustion, and isothermal compression.

12. The multi-stage system of claim 1, wherein the first compression chamber and the second compression chamber are each configured for one of: sequential compression, sequential expansion, polytropic expansion, isometric combustion, and isothermal compression.

13. The multi-stage system of claim 1, wherein the power transfer shaft further comprises a rotary valve in selectable fluid communication with the inlet and the outlet.

14. The multi-stage system of claim 1, wherein the first compression chamber is in selective fluid communication with the second compression chamber.

15. The multi-stage system of claim 1, wherein at least a portion of the piston defines a geometrical cross-sectional shape other than a circle, and wherein the geometrical cross-sectional shape is configured to interact with the cylinder to prevent rotation of the piston within the cylinder.

16. The multi-stage system of claim 1, wherein an outer piston surface of the piston defines a planar portion configured to interact with the cylinder to prevent rotation of the piston within the cylinder.

17. The multi-stage system of claim 1, wherein the multi-stage system comprises one or more ports, and wherein the one or more ports are configured to be selectively covered and uncovered to achieve combustion events and compression events.

18. The multi-stage system of claim 1, wherein the multi-stage system comprises one or more valves, and wherein the one or more valves are configured to be selectively opened and closed to achieve combustion events and compression events.

19. The multi-stage system of claim 1, wherein the piston is configured to reciprocate multiple times within the cylinder per rotation of the power transfer shaft.

20. A multi-stage system, comprising:

a cylinder, the cylinder comprising an inlet thereto and an outlet therefrom;

a power transfer shaft configured for rotation within the cylinder, the power transfer shaft comprising a shaft portion and an infinity portion; and a piston configured to reciprocate within the cylinder, the piston defining a first compression chamber and a second compression chamber within the cylinder;

wherein:

one of the infinity portion of the power transfer shaft or the piston defines an infinity profile;

the other one of the infinity portion of the power transfer shaft or the piston slidably engages the infinity profile; and the power transfer shaft further comprises a rotary valve in selectable fluid communication with the inlet and the outlet.

* * * * *